US008912996B2

(12) United States Patent
Kim et al.

(10) Patent No.: US 8,912,996 B2
(45) Date of Patent: Dec. 16, 2014

(54) SCAN DRIVER AND DRIVING METHOD THEREOF

(75) Inventors: Yong-Jae Kim, Yongin (KR); Bo-Yong Chung, Yongin (KR); Dong-Beom Lee, Yongin (KR); Min-Hyuk Choi, Yongin (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 248 days.

(21) Appl. No.: 13/449,875

(22) Filed: Apr. 18, 2012

(65) Prior Publication Data

US 2013/0127807 A1 May 23, 2013

(30) Foreign Application Priority Data

Nov. 18, 2011 (KR) ..... 10-2011-0120914

(51) Int. Cl.
*G09G 3/36* (2006.01)
*G09G 5/00* (2006.01)

(52) U.S. Cl.
CPC ..... *G09G 5/00* (2013.01)
USPC ..... 345/100; 345/76; 345/204; 377/64

(58) Field of Classification Search
CPC ..... G09G 3/3677; G09G 2310/0286; G09G 3/3266; G09G 2300/0408; G09G 2310/0267; G09G 3/3648; G09G 3/3674; G09G 2310/0205
USPC ..... 345/76, 82, 87, 100, 204, 211; 377/64
See application file for complete search history.

(56) References Cited

U.S. PATENT DOCUMENTS

| | | | | |
|---|---|---|---|---|
| 2005/0280613 | A1* | 12/2005 | Takei et al. | 345/76 |
| 2006/0238482 | A1* | 10/2006 | Jang et al. | 345/100 |
| 2007/0242000 | A1* | 10/2007 | Shin | 345/76 |
| 2008/0062071 | A1* | 3/2008 | Jeong | 345/46 |
| 2010/0177087 | A1* | 7/2010 | Han | 345/213 |
| 2011/0227884 | A1* | 9/2011 | Chung | 345/204 |

FOREIGN PATENT DOCUMENTS

| | | | |
|---|---|---|---|
| JP | 08-273387 | A | 10/1996 |
| JP | 2009-181612 | A | 8/2009 |
| JP | 2010-040074 | A | 2/2010 |
| JP | 2010-238323 | A | 10/2010 |
| KR | 10-2011-0042516 | A | 4/2011 |

* cited by examiner

*Primary Examiner* — Koosha Sharifi-Tafreshi
(74) *Attorney, Agent, or Firm* — Lee & Morse, P.C.

(57) ABSTRACT

A scan driver including sequentially arranged scan driving blocks, each of the blocks including a first node receiving a signal input into a driving signal input terminal based on a clock signal input into a second-clock-signal input terminal, a second node receiving a clock signal input into a first-clock-signal input terminal, a first transistor including a gate electrode connected to the second node, one electrode receiving an output control signal, and another electrode connected to an output terminal, a second transistor including a gate electrode connected to the first node, one electrode connected to a third-clock-signal input terminal, and another electrode connected to the output terminal, and a third transistor including a gate electrode connected to the third-clock-signal input terminal and one electrode connected to the first node and configured to transfer a voltage of the output terminal to the first node.

30 Claims, 13 Drawing Sheets

SCAN DRIVER AND DRIVING METHOD THEREOF

CROSS-REFERENCE TO RELATED APPLICATION

This application claims priority to and the benefit of Korean Patent Application No. 10-2011-0120914 filed in the Korean Intellectual Property Office on Nov. 18, 2011, the entire contents of which are incorporated herein by reference.

BACKGROUND

1. Field

Embodiments relate to a scan driver and a driving method thereof, and more particularly, to a scan driver capable of preventing malfunction of a display device and a driving method thereof.

2. Description of the Related Art

In a panel display, scan signals having a gate-on voltage are sequentially applied to a plurality of scan lines and data signals corresponding to the scan signals and having a gate-on voltage are applied to a plurality of data lines, in order to display a video. A plurality of thin film transistors (TFTs) are used in the panel display in order to drive the panel display. In recent years, a polycrystalline TFT using polycrystalline silicon has been used in the panel display.

In the polycrystalline TFT, changes in characteristics such as a change in threshold voltage as time elapses may occur when on-bias voltage is largely applied. A problem may occur in reliability of a driving circuit due to the change in characteristics of the polycrystalline TFT, thereby causing malfunction of the panel display.

The above information disclosed in this Background period is only for enhancement of understanding of the background of the invention and therefore it may contain information that does not form the prior art that is already known in this country to a person of ordinary skill in the art.

SUMMARY

One or more embodiments provide a scan driver configured to prevent malfunction of a display device and a driving method thereof.

One or more embodiments provide a scan driver including a plurality of scan driving blocks arranged sequentially, and each of the plurality of scan driving blocks includes a first node to which a signal input into a driving signal input terminal is transferred in accordance with a clock signal input into a second clock signal input terminal; a second node to which a clock signal input into a first clock signal input terminal is transferred; a first transistor including a gate electrode connected to the second node, one electrode into which an output control signal is input, and the other electrode connected to an output terminal; a second transistor including a gate electrode connected to the first node, one electrode connected to a third clock signal input terminal, and the other electrode connected to the output terminal; and a third transistor including a gate electrode connected to the third clock signal input terminal and one electrode connected to the first node and transferring voltage of the output terminal to the first node.

The scan driver may further include a first capacitor including one electrode connected to the first node and the other electrode connected to the output terminal.

The scan driver may further include a second capacitor including one electrode to which the output control signal is applied and the other electrode connected to the second node.

The scan driver may further include a fourth transistor including a gate electrode connected to the first clock signal input terminal and one electrode connected to the second node and transferring gate-on voltage to the second node.

The fourth transistor may further include the other electrode connected to the first clock signal input terminal.

The fourth transistor may further include the other electrode connected to power source voltage at a logic low level.

The scan driver may further include a fifth transistor including a gate electrode connected to the second clock signal input terminal, one electrode connected to the driving signal input terminal, and the other electrode connected to the first node.

The scan driver may further include a sixth transistor transferring gate-off voltage to the first node according to the output control signal.

The sixth transistor may include one electrode connected any one of the first clock signal input terminal, the second clock signal input terminal, and the third clock signal input terminal, a gate electrode into which the output control signal is input, and the other electrode connected to the first node.

The sixth transistor may include a gate electrode into which the output control signal is input, one electrode connected to power source voltage at a logic high level, and the other electrode connected to the second node.

The scan driver may further include a seventh transistor transferring the clock signal input to the first clock signal input terminal to the second node according to the signal input into the driving signal input terminal.

The seventh transistor may include a gate electrode connected to the driving signal input terminal, one electrode to which the clock signal input to the first clock signal input terminal is applied, and the other electrode connected to the second node.

The scan driver may further include an eighth transistor including a gate electrode connected to the second clock signal input terminal, one electrode connected to the first clock signal input terminal, and the other electrode connected to one electrode of the seventh transistor.

The seventh transistor may include a gate electrode connected to the first node, one electrode connected to the first clock signal input terminal, and the other electrode connected to the second node.

The scan driver may further include a ninth transistor including a gate electrode connected to the second node, one electrode connected to the other electrode of the third transistor, and the other electrode connected to the output terminal.

A first clock signal may be input into the first clock signal input terminal of any one first scan driving block among the plurality of scan driving blocks, a second clock signal may be input into the second clock signal input terminal thereof, and a third clock signal may be input into the third clock signal input terminal thereof, and the first clock signal may have a cycle of 2 duty which is repeated to a logic low level of 1 duty and a logic high level of 1 duty, the second clock signal may be a signal shifted from the first clock signal by ½ duty, and the third clock signal may be a signal shifted from the second clock signal by ½ duty.

The second clock signal may be input into a first clock signal input terminal of a second scan driving block arranged after the first scan driving block, the third clock signal may be input into a second clock signal input terminal thereof, and a fourth clock signal which is a signal shifted from the third clock signal by ½ duty may be input into a third clock signal input terminal thereof.

A first clock signal may be input into the first clock signal input terminal of any one first scan driving block among the plurality of scan driving blocks, a second clock signal may be input into the second clock signal input terminal thereof, and a third clock signal may be input into the third clock signal input terminal thereof, and the first clock signal may have a cycle of 4 duty which is repeated to a logic low level of 1 duty and a logic high level of 3 duty, the second clock signal may be a signal shifted from the first clock signal by 1 duty, and the third clock signal may be a signal shifted from the second clock signal by 1 duty.

The second clock signal may be input into a first clock signal input terminal of a second scan driving block arranged after the first scan driving block, the third clock signal may be input into a second clock signal input terminal thereof, and a fourth clock signal which is a signal shifted from the third clock signal by 1 duty may be input into a third clock signal input terminal thereof.

The third clock signal may be input into a first clock signal input terminal of a third scan driving block arranged after the second scan driving block, the fourth clock signal may be input into a second clock signal input terminal thereof, and the first clock signal may be input into a third clock signal input terminal thereof.

The fourth clock signal may be input into a first clock signal input terminal of a fourth scan driving block arranged after the third scan driving block, the first clock signal may be input into a second clock signal input terminal thereof, and the second clock signal may be input into a third clock signal input terminal thereof.

Scan signals of scan driving blocks previously arranged may be input into the driving signal input terminals of the plurality of scan driving blocks.

Another exemplary embodiment of the present invention provides a scan driver including a plurality of scan driving blocks arranged sequentially and each of the plurality of scan driving blocks includes: a first node to which a signal input into a driving signal input terminal is transferred; a second node to which gate-on voltage is transferred in accordance with a clock signal input into a first clock signal input terminal; a first transistor including a gate electrode connected to the second node, one electrode into which an output control signal is input, and the other electrode connected to an output terminal; a second transistor including a gate electrode connected to the first node, one electrode connected to a second clock signal input terminal, and the other electrode connected to the output terminal; and a third transistor including a gate electrode connected to the second clock signal input terminal, one electrode connected to the first node, and the other electrode connected to the output terminal.

The scan driver may further include a fourth transistor including a gate electrode connected to the first clock signal input terminal, one electrode connected to power source voltage of gate-on voltage, and the other electrode connected to the second node.

The scan driver may further include a fifth transistor transferring a signal input into the driving signal input terminal to the first node.

The fifth transistor may include a gate electrode connected to the first clock signal input terminal, one electrode connected to the driving signal input terminal, and the other electrode connected to the first node.

The fifth transistor may include a gate electrode connected to the driving signal input terminal, one electrode connected to the driving signal input terminal, and the other electrode connected to the first node.

The scan driver may further include a sixth transistor including a gate electrode connected to the first node, one electrode connected to the first clock signal input terminal, and the other electrode connected to the second node.

The scan driver may further include a seventh transistor including a gate electrode to which the output control signal is applied, one electrode connected power source voltage of gate-off voltage, and the other electrode connected to the first node.

The scan driver may further include a first capacitor including one electrode connected to the first node and the other electrode connected to the output terminal.

The scan driver may further include a second capacitor including one electrode to which the output control signal is applied and the other electrode connected to the second node.

A first clock signal may be input into first clock signal input terminals of a plurality of first scan driving blocks among the plurality of scan driving blocks and a second clock signal may be input into a second clock signal input terminal thereof, and the second clocks signals may be input into first clock signal input terminals of the rest of the plurality of second scan driving blocks among the plurality of scan driving blocks and the first clock signal may be input into second clock signal input terminals thereof.

The second clock signal may be a signal shifted by a duty of the first clock signal.

The scan signals of the second scan driving blocks previously arranged may be input into the driving signal input terminals of the plurality of first scan driving blocks and the scan signals of the first scan driving blocks previously arranged may be input into the driving signal input terminals of the plurality of second scan driving blocks.

Yet an exemplary embodiment of the present invention provides a driving method of a scan driver including a plurality of scan driving blocks including a first node, a second node, a first transistor including a gate electrode connected to the second node and transferring an output control signal to an output terminal, a second transistor including a gate electrode connected to the first node and transferring a first clock signal to the output terminal, a third transistor including a gate electrode to which the first clock signal is applied and one electrode connected to the first node and transferring voltage of the output terminal to the first node, and a capacitor connected to the first node and the output terminal, the method including: varying voltage of the second node by an output control signal of gate-on voltage; and turning on the first transistor by varying the voltage of the second node and outputting the output control signal of the gate-on voltage to the output terminal as a scan signal.

The varying of the voltage of the second node and the outputting of the output control signal of the gate-on voltage as the scan signal may be performed concurrently in the plurality of scan driving blocks.

The driving method may further include transferring gate-off voltage to the first node in accordance with the output control signal of the gate-on voltage.

The driving method may further include: applying a scan signal of gate-on voltage output from a scan driving block previously arranged among the plurality of scan driving blocks in accordance with a second clock signal, to the first node; turning on the second transistor by the gate-on voltage of the first node and outputting a first clock signal of gate-off voltage to the output terminal as the scan signal; and charging the capacitor with the gate-on voltage of the first node and the gate-off voltage of the output terminal.

The driving method may further include transferring a third clock signal of the gate-off voltage to the second node in accordance with the second clock signal and the scan signal of the gate-on voltage output by the previously arranged scan driving block.

The driving method may further include varying the first clocks signal as the gate-on voltage; turning on the second transistor by a bootstrap through the capacitor; and outputting the first clock signal of the gate-on voltage to the output terminal as the scan signal.

The driving method may further include varying the first clock signal as the gate-off voltage; and maintaining the turn-on state of the second transistor with the voltage charged in the capacitor and outputting the first clock signal of the gate-off voltage to the output terminal.

The driving method may further include transferring the gate-on voltage to the second node in accordance with a third clock signal of the gate-on voltage; turning on the first transistor and the fourth transistor with the gate-on voltage of the second node and outputting the output control signal of the gate-off voltage to the output terminal as the scan signal; turning on the third transistor in accordance with the first clock signal of the gate-on voltage; and transferring the output control signal of the gate-off voltage to the first node and turning off the second transistor.

In one or more embodiments of a scan driver including one or more features described herein does not use a transistor to which a high on-bias voltage is applied, and thus, a malfunction caused due to the change in characteristics of such a transistor, when such a transistor is employed, can be prevented.

One or more embodiments of a scan driver including one or more features described herein is configured to prevent wobbling of an output signal due to a change in voltage of a clock signal after a scan driving block outputs the scan signal at a logic low level, thereby preventing the malfunction of a display device.

One or more embodiments of a scan driver including one or more features described herein can be driven only by four clock signals and an output control signal, and as a result, a number of wires can be decreased and a process gain increases and a design area can be reduced by simplifying the structure.

DETAILED DESCRIPTION

Figure 1:
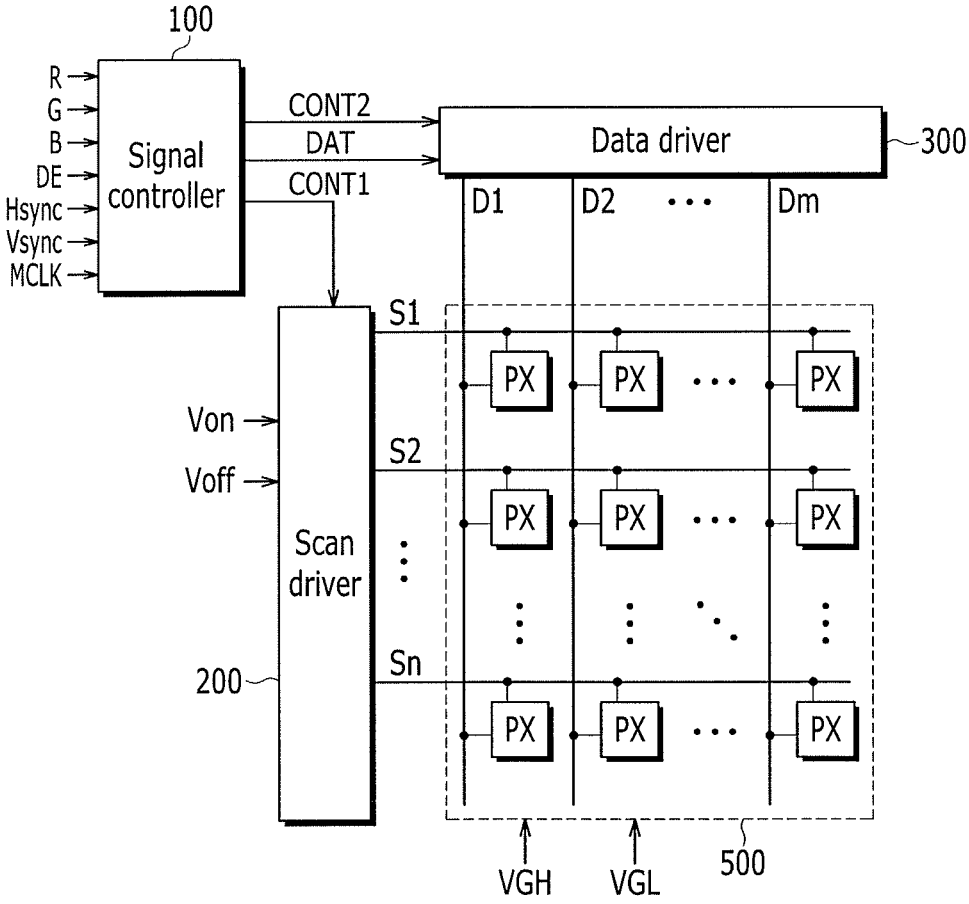
FIG. 1 is a block diagram illustrating a display device according to an exemplary embodiment.

One or more embodiments will be described more fully hereinafter with reference to the accompanying drawings, in which exemplary embodiments of the invention are shown. As those skilled in the art would realize, the described embodiments may be modified in various different ways, all without departing from the spirit or scope of the present invention.

Further, in the exemplary embodiments, like reference numerals designate like elements throughout the specification representatively in a first exemplary embodiment and only elements other than those of the first exemplary embodiment will be described.

The drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising", etc. will be understood to imply the inclusion of stated elements but not the exclusion of any other elements.

FIG. 1 is a block diagram illustrating a display device according to an exemplary embodiment.

Referring to FIG. 1, a display device includes a signal controller 100, a scan driver 200, a data driver 300, and a display unit 500.

The signal controller 100 receives video signals R, G, and B input from an external device and input control signals controlling the display thereof. The video signals R, G, and B store luminance information of each pixel PX and the luminance has a predetermined number, for example, 1024 ($=2^{10}$), 256 ($=2^{8}$), or 64 ($=2^{6}$) grays. Examples of the input control signals include a vertical synchronization signal Vsync, a horizontal synchronization signal Hsync, a main clock MCLK, a data enable signal DE, and the like.

The signal controller 100 processes the input video signals R, G, and B so as to be suitable for operation conditions of the display unit 500 and the data driver 300 based on the input video signals R, G, and B and the input control signals and generates a scan control signal CONT1, a data control signal CONT2, and a video data signal DAT. The signal controller 100 transfers the scan control signal CONT1 to the scan driver 200. The signal controller 100 transfers the data control signal CONT2 and the video data signal DAT to the data driver 300.

The display unit 500 includes a plurality of pixels PX which are connected to a plurality of scan lines S1-Sn, a plurality of data lines D1-Dm. The plurality of signal lines S1-Sn and the plurality of data lines D1-Dm may be arranged in a substantially matrix form. The plurality of scan lines S1-Sn extend in a substantially row direction to be substantially parallel to each other. The plurality of data lines D1-Dm extend in a substantially column direction to be substantially parallel to each other. The plurality of pixels PX of the display unit 500 receive the first power source voltage VGH and the second power source voltage VGL from the outside.

The scan driver 200 is connected to the plurality of scan lines S1-Sn and applies scan signals to the plurality of scan lines S1-Sn, in which the scan signals are configured by combination of gate-on voltage Von turning on the application of the data signal for the pixel PX and gate-off voltage Voff turning off the application of the data signal for the pixel PX according to the scan control signal CONT1.

The scan control signal CONT1 includes a scan start signal SSP, a clock signal CLK, an output control signal GCK, and the like. The scan start signal SSP is a signal generating a first scan signal for displaying a video of one frame. The clock signal CLK is a synchronization signal for applying the scan signals to the plurality of scan lines S1-Sn sequentially. The output control signal GCK is a signal for controlling so that the scan signals are applied to the plurality of scan lines S1-Sn at once.

The data driver 300 is connected to the plurality of data lines D1-Dm to select gray voltage according to the video data signal DAT. The data driver 300 applies the gray voltage selected according to the data control signal CONT2 to the plurality of data lines D1-Dm as the data signal.

Each of the drivers 100, 200, and 300 may be mounted outside of a pixel area as at least one integrated circuit chip, mounted on a flexible printed circuit film, attached to the display unit 500 as a tape carrier package (TCP), mounted on a separate printed circuit board, or integrated at the outside of the pixel area together with the signal lines S1-Sn and D1-Dm.

One or more embodiments of the display device employing one or more features described herein may be driven in a simultaneous light-emitting mode using a frame which includes a scan period while the data signal is transferred to and written in each of the plurality of pixels PX and a light emitting period while the light is emitted according to the data signal written in each of the plurality of pixels PX.

Figure 2:
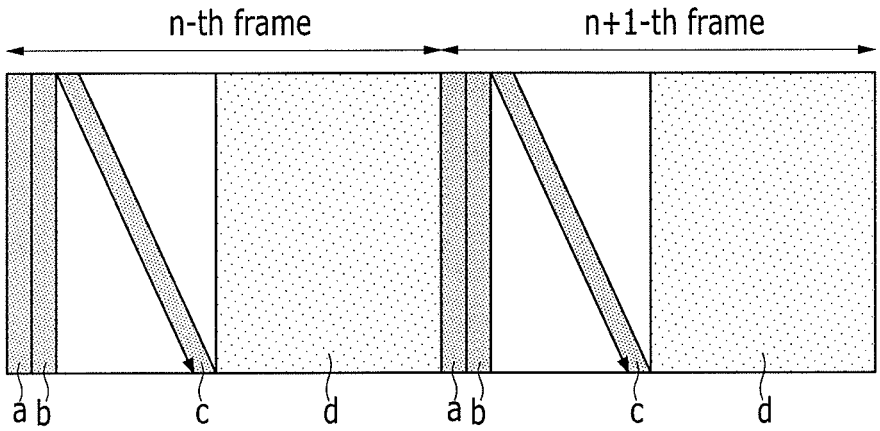
FIG. 2 is a diagram illustrating a driving operation of a simultaneous light-emitting mode of a display device according to an exemplary embodiment.

FIG. 2 is a diagram illustrating a driving operation of a simultaneous light-emitting mode of a display device according to an exemplary embodiment.

While FIG. 2 illustrates an exemplary embodiment of a display device, e.g., an organic light emitting diode display using an organic light emitting diode. Embodiments, however, are not limited thereto and may be applied to various panel displays.

The driving mode of the display device includes resetting a driving voltage of the organic light emitting diode of the pixel (a), compensating for a threshold voltage of a driving transistor of the pixel (b), scanning, during which the respective data signal is transferred to each of the plurality of pixels (c), and emitting light in response to the data signal respectively transferred to the plurality of pixels (d).

Referring to FIG. 2, scanning (c) is sequentially performed for each scan line, but resetting (a), compensating of the threshold voltage (b), and emitting of the light (d) may be simultaneously performed on the entire display unit 500 at once.

In one or more embodiments, during scanning (c), the scan driver 200 of the display device may apply the scan signals of the gate-on voltage Von to the plurality of scan lines S1-Sn sequentially, and during resetting (a) and during compensating of the threshold voltage (b), the scan driver 200 may apply the scan signals of the gate-on voltage Von to the plurality of scan lines S1-Sn simultaneously. That is, the scan driver 200 may perform the sequential application and the simultaneous application of the scan signals depending on the driving steps of the display device.

Figure 3:
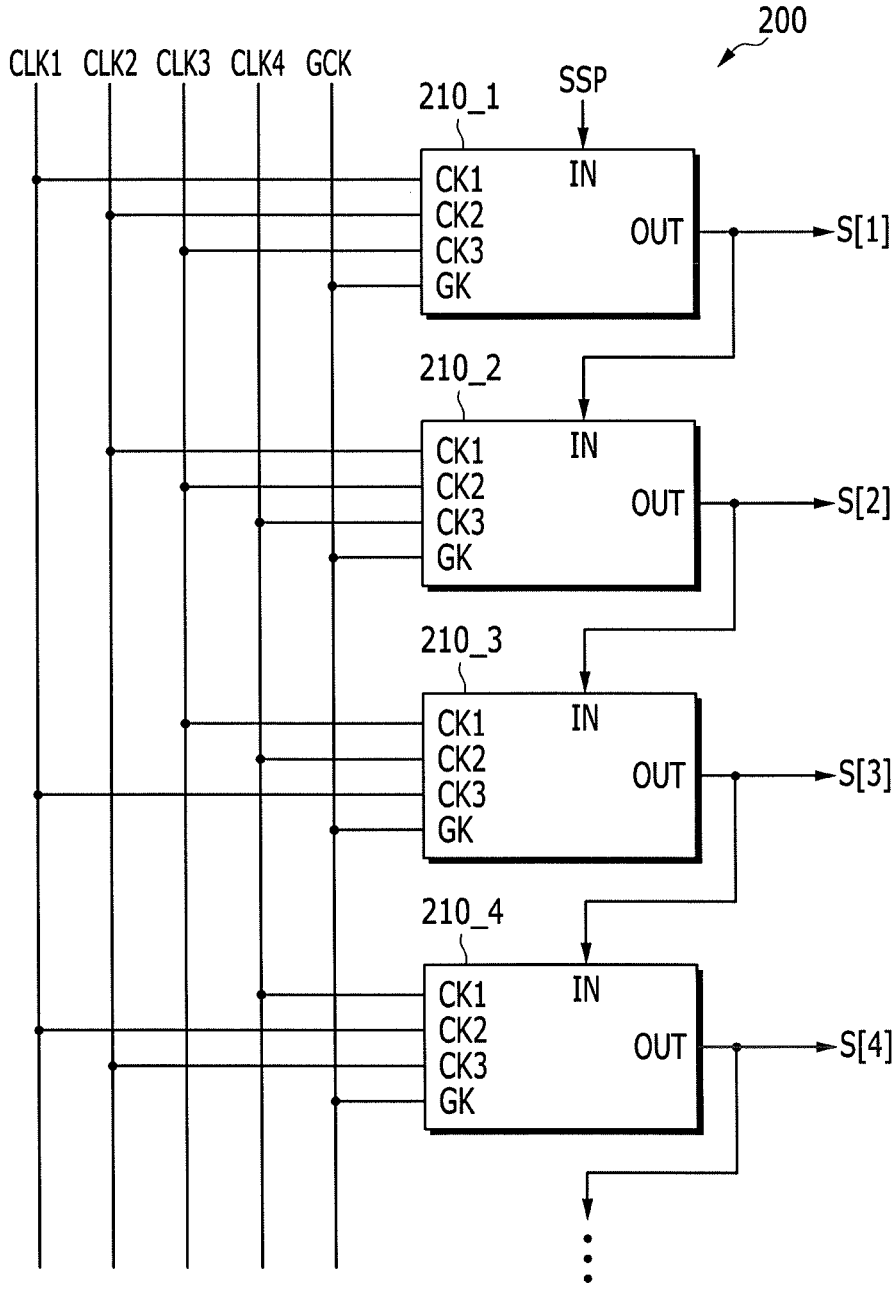
FIG. 3 is a block diagram illustrating a configuration of a scan driver according to an exemplary embodiment.

FIG. 3 is a block diagram illustrating a configuration of a scan driver according to an exemplary embodiment.

Referring to FIG. 3, the scan driver 200 may include a plurality of scan driving blocks 210_1, 210_2, 210_3, 210_4, . . . which are arranged sequentially. Each of the plurality of scan driving blocks 210_1, 210_2, 210_3, 210_4, . . . receives input signals to generate scan signals S[1], S[2], S[3], S[4], . . . transferred to each of the plurality of scan lines S1-Sn.

Each of the plurality of scan driving blocks 210_1, 210_2, 210_3, 210_4, . . . includes a first clock signal input terminal CK1, a second clock signal input terminal CK2, a third clock signal input terminal CK3, an output control signal input terminal GK, a driving signal input terminal IN, and an output terminal OUT.

Three clock signals among a first clock signal CLK1, a second clock signal CLK2, a third clock signal CLK3, and a fourth clock signal CLK4 are input to the first clock signal input terminal CK1, the second clock signal input terminal CK2, and the third clock signal input terminal CK3 of each of the plurality of scan driving blocks 210_1, 210_2, 210_3, 210_4, . . . . The first clock signal CLK1, the second clock signal CLK2, and the third clock signal CLK3 are input to the first scan driving block 210_1. The second clock signal CLK2, the third clock signal CLK3, and the fourth clock signal CLK4 are input to the second scan driving block 210_2. The third clock signal CLK3, the fourth clock signal CLK4, and the first clock signal CLK1 are input to the third scan driving block 210_3. The fourth clock signal CLK4, the first clock signal CLK1, and the second clock signal CLK2 are input to the fourth scan driving block 210_4. By this method, three clock signals among four clock signals CLK1 to CLK4 are rotationally input to the plurality of scan driving blocks 210_1, 210_2, 210_3, 210_4, . . . which are arranged sequentially.

The output control signals GCK are input to the output control signal input terminals GK of the plurality of scan driving blocks 210_1, 210_2, 210_3, 210_4, etc.

The scan signals of adjacent ones of the scan driving blocks 210_*n* are input to the driving signal input terminals IN of the plurality of scan driving blocks 210_1, 210_2, 210_3, 210_4, . . . . That is, when the plurality of scan driving blocks 210_1, 210_2, 210_3, 210_4, . . . output the scan signals sequentially, a scan signal S[k−1] of a k−1-th scan driving block 210_*k*−1 is input to a driving signal input terminal IN of a k-th scan driving block 210_*k*. In this case, the scan start signal SSP is input to the driving signal input terminal IN of the first scan driving block 210_1.

The scan driving blocks 210_1, 210_2, 210_3, 210_4, . . . each output the scan signals S[1], S[2], S[3], S[4], . . . , which are generated according to the signals input to the first clock signal input terminals CK1, the second clock signal input terminals CK2, the third clock signal input terminals CK3, the output control signal input terminals GK, and the driving signal input terminals IN, to the output terminals Out.

The first scan driving block 210_1 receives the scan start signal SSP to transfer the generated scan signal S[1] to the first scan line S1 and the driving signal input terminal IN of the second scan driving block 210_2. The k-th arranged scan driving block 210_*k* receives the scan signal S[k−1] output from the k−1-th arranged scan driving block 210_*k*−1 to output the generated scan signal S[k] (1<k<=n).

Figure 4:
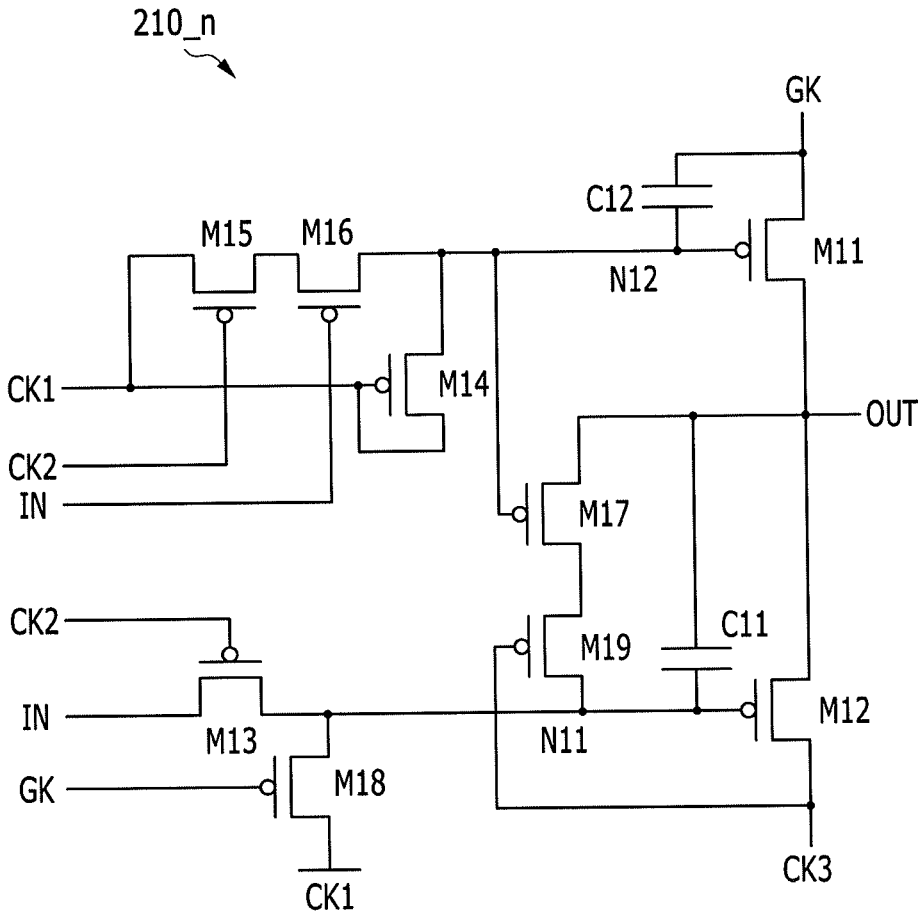
FIG. 4 is a circuit diagram illustrating a scan driving block included in the scan driver of FIG. 3 according to an exemplary embodiment.

FIG. 4 is a circuit diagram illustrating a scan driving block included in the scan driver of FIG. 3 according to an exemplary embodiment.

Referring to FIG. 4, the scan driving block includes a plurality of transistors M11, M12, M13, M14, M15, M16, M17, M18, and M19 and a plurality of capacitors C11 and C12.

The first transistor M11 includes a gate electrode connected to a second node N12, one electrode connected to an output control signal input terminal GK, and another electrode connected to the output terminal OUT.

The second transistor M12 includes a gate electrode connected to a first node N11, one electrode connected to the third clock signal input terminal CK3, and another electrode connected to the output terminal OUT.

The third transistor M13 includes a gate electrode connected to the second clock signal input terminal CK2, one electrode connected to the driving signal input terminal IN, and another electrode connected to the first node N11.

The fourth transistor M14 includes a gate electrode connected to the first clock signal input terminal CK1, one electrode connected to the first clock signal input terminal CK1, and another electrode connected to the second node N12.

The fifth transistor M15 includes a gate electrode connected to the second clock signal input terminal CK2, one electrode connected to the first clock signal input terminal CK1, and another electrode connected to one electrode of the sixth transistor M16.

The sixth transistor M16 includes a gate electrode connected to the driving signal input terminal IN, one electrode connected to the other electrode of the fifth transistor M15, and another electrode connected to the second node N12.

The seventh transistor M17 includes a gate electrode connected to the second node N12, one electrode connected to the other electrode of the ninth transistor M19, and another electrode connected to the output terminal OUT.

The eighth transistor M18 includes a gate electrode connected to the output control signal input terminal GK, one electrode connected to the first clock signal input terminal CK1, and another electrode connected to the first node N11. Herein, one electrode of the eighth transistor M18 is connected to the first clock signal input terminal CK1, but one electrode of the eighth transistor M18 may be connected with any one of the second clock signal input terminal CK2 and/or the third clock signal input terminal CK3.

The ninth transistor M19 includes a gate electrode connected to the third clock signal input terminal CK3, one electrode connected to the first node N11, and another electrode connected to one electrode of the seventh transistor M17.

The first capacitor C11 includes one electrode connected to the first node N11 and another electrode connected to the output terminal OUT. The second capacitor C12 includes one electrode connected to the output control signal input terminal GK and another electrode connected to the second node N12.

In the exemplary embodiment shown in FIG. 4, the plurality of transistors M11, M12, M13, M14, M15, M16, M17, M18, M19 are p-channel field effect transistors. In such embodiments, a gate-on voltage for turning on the plurality of transistors M11, M12, M13, M14, M15, M16, M17, M18, M19 is any voltage within a relatively logic low level voltage capable of turning on the transistors M11, M12, M13, M14, M15, M16, M17, M18, M19 and a gate-off voltage turning off or maintaining off the plurality of transistors M11, M12, M13, M14, M15, M16, M17, M18, M19 is any voltage within a relatively high logic level capable of turning off or maintaining off the plurality of transistors M11, M12, M13, M14, M15, M16, M17, M18, M19. In the exemplary embodiment of FIG. 4, the plurality of transistors M11, M12, M13, M14, M15, M16, M17, M18, M19 are p-channel field effect transistors, but the plurality of transistors M11, M12, M13, M14, M15, M16, M17, M18, M19 may be n-channel field effect transistors. Gate-on voltage turning on the n-channel field effect transistors is a relatively high logic level voltage and gate-off voltage turning off the n-channel field effect transistors is a relatively low logic level voltage.

Figure 5:
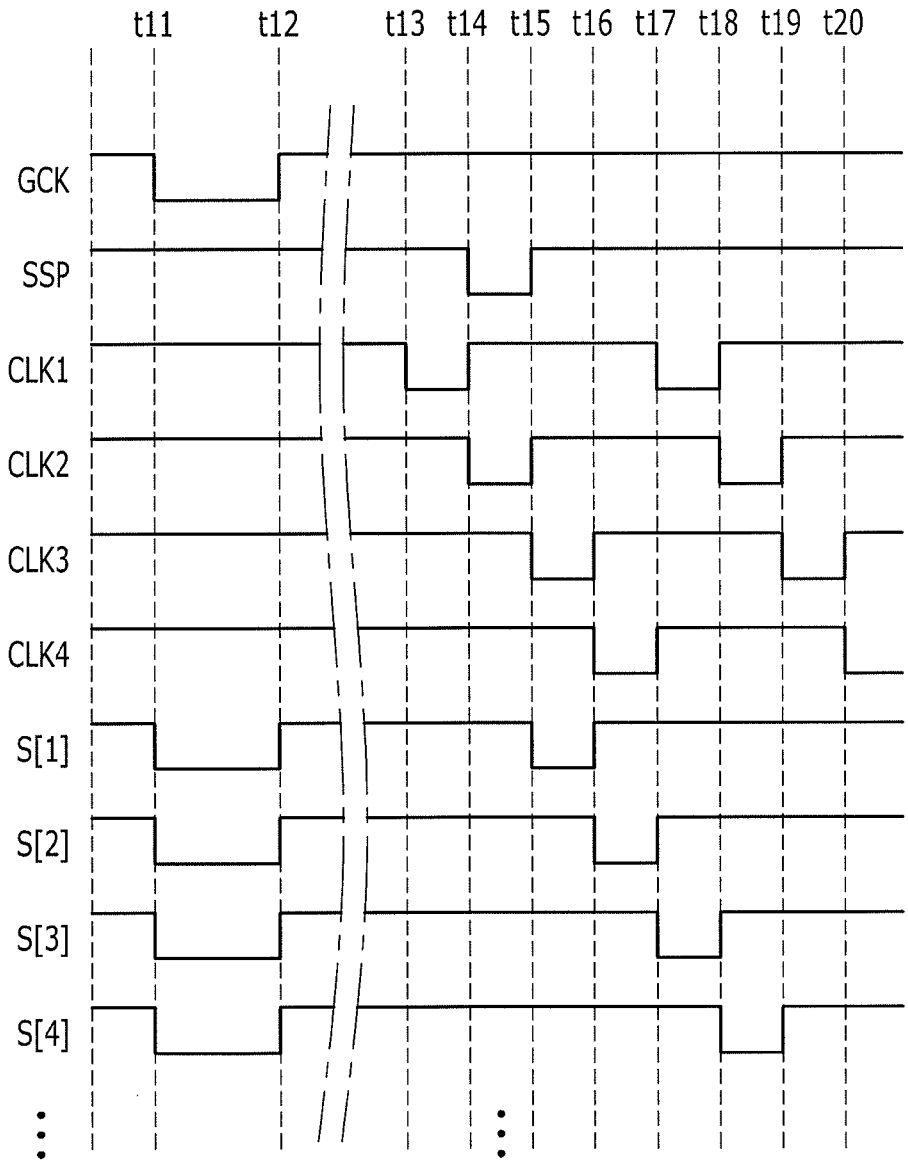
FIG. 5 is a timing diagram illustrating a driving method of the scan driver of FIG. 3.

FIG. 5 is a timing diagram illustrating a driving method of the scan driver 200 of FIG. 3.

Referring to FIGS. 3 to 5, the scan driver 200 may simultaneously output the scan signals having a gate-on voltage to the plurality of scan lines S1-Sn during the resetting (a) and/or the compensating of the threshold voltage (b) periods and may sequentially output the scan signals having a gate-on voltage to the plurality of scan lines S1-Sn during the scanning (c).

Referring to FIG. 5, a period t11 to t12 represents a period of any one of the resetting (a) and the compensating of the threshold voltage (b) in which the scan signals of the gate-on voltage are simultaneously output to the plurality of scan lines S1-Sn. In the period t11 to t12, the output control signal GCK is applied as the logic low level voltage and the scan start signal SSP, the first clock signal CLK1, the second clock signal CLK2, the third clock signal CLK3, and the fourth clock signal CLK4 are applied as the logic high level voltage. The third transistor M13, the fourth transistor M14, the fifth transistor M15, the sixth transistor M16, and the ninth transistor M19 are turned off and the eighth transistor M18 is turned on by a logic high level signal.

In the period t11 to t12, the second node N12 connected to the other electrode of the second capacitor C12 and the gate electrode of the first transistor M11 is in a floating state. When the output control signal GCK decreases from the logic high level voltage to the logic low level voltage at a time t11, the voltage of the second node N12 in the floating state decreases to the logical low level by coupling depending on a change in the voltage of the output control signal GCK. As the voltage of the second node N12 decreases to the logic low level, the first transistor M11 is turned on. As the first transistor M11 is turned on, the out control signal GCK at the logic low level is transferred to the output terminal OUT through the first transistor M11.

As such, the plurality of scan driving blocks 220_1, 220_2, 220_3, 220_4, . . . simultaneously output the scan signals S[1], S[2], S[3], S[4], . . . at the logic low level.

After period t13, during the scanning (c), the scan signals of the gate-on voltage are sequentially output to the plurality of scan lines S1-Sn. After period t13, the output control signal GCK is applied as the logic high level voltage. The scan start signal SSP is applied as the logic low level voltage in a period t14 to t15.

The first clock signal CLK1 has a repeating cycle corresponding to four duty periods. More particularly, the first clock signal CLK1 may include a repeating cycle of one duty period at a logic low level and three duty periods at a logic high level. Herein, the duty or duty period corresponds to a time period during which a voltage turning on the transistors included in the scan driving blocks is applied. Thus, e.g., in the case of the above described first clock signal CLK1, during each cycle thereof, the first clock signal CLK1 may be at a low logic level for a predetermined period of time (i.e., duty) and may be at a logic high level for a period corresponding to three times the predetermined period of time. The second clock signal CLK2 is a signal which is shifted from the first clock signal CLK1 by one duty. The third clock signal CLK3 is a signal in which the second clock signal CLK2 is shifted by one duty. The fourth clock signal CLK4 is a signal in which the third clock signal CLK3 is shifted by one duty.

First, an exemplary operation of the first scan driving block 210_1 will be described. The first scan driving block 210_1 uses the first clock signal CLK1, the second clock signal CLK2, and the third clock signal CLK3 among four clock signals CLK1 to CLK4.

In a period t13 to t14, the first clock signal CLK1 is applied as the logic low level voltage and the rest clock signals CLK2 and CLK3 are applied as the logic high level voltage. The fourth transistor M14 is turned on and the logic low level voltage is transferred to the second node N12. The first transistor M11 is turned on and the logic high level voltage is transferred to the output terminal OUT through the turned-on first transistor M11.

In a period t14 to t15, the second clock signal CLK1 and the scan start signal SSP are applied as the logic low level voltage and the rest clock signals CLK1 and CLK3 are applied as the logic high level voltage. The third transistor M13, the fifth transistor M15, and the sixth transistor M16 are turned on by the logic low level signal. The logic low level voltage is transferred to the first node N11 and the logic high level voltage is transferred to the second node N12. The first transistor M11 is turned off by the logic high level voltage of the second node N12. The second transistor M12 is turned on by the logic low level voltage of the first node N11. The logic high level voltage is transferred to the output terminal OUT through the turned-on second transistor M12. In this case, the first capacitor C11 is charged by a voltage difference between the logic low level voltage of the first node N11 and the logic high level voltage of the output terminal OUT.

In a period between t15 to t16, the third clock signal CLK3 is applied as the logic low level voltage and the rest clock signals CLK1 and CLK2 and the scan start signal SSP are applied as the logic high level voltage. The third transistor M13, the fifth transistor M15, and the sixth transistor M16 are turned off by the logic high level signal. The second node N12 is in the floating state and the voltage of the second node N12 is maintained at the logic high level. The second transistor M12 is fully turned on by the bootstrap through the first capacitor C11. The logic low level voltage is transferred to the output terminal OUT through the turned-on second transistor M12.

As a result, the first scan driving block 210_1 outputs the scan signal S[1] at the logic low level. The scan signal S[1] at the logic low level in the first scan driving block 210_1 is transferred to the driving signal input terminal IN of the second scan driving block 210_2.

In a period between t16 to t17, all the input signals CLK1, CLK2, CLK3, SSP, and GCK are applied as the logic high level voltage. The second transistor M12 is maintained in the turned-on state by the voltage charged in the first capacitor C11 and the logic high level voltage is transferred to the output terminal OUT.

In a period between t17 to t18, the first clock signal CLK1 is applied as the logic low level voltage. The fourth transistor M14 is turned on by the first clock signal CLK1 and the logic low level voltage is transferred to the second node N12. The first transistor M11 is turned on by the logic low level voltage of the second node N12. The logic high level voltage is transferred to the output terminal OUT through the turned-on first transistor M11. In this case, the second capacitor C12 is charged by a voltage difference between the logic low level voltage of the second node N12 and the logic high level voltage of the output control signal input terminal GK.

In a period between t18 to t19, the second clock signal CLK2 is applied as the logic low level voltage. The third transistor M13 and the fifth transistor M15 are turned on by the second clock signal CLK2. The logic high level voltage is transferred to the first node N11 through the turned-on third transistor M13. The second transistor M12 is turned off by the logic high level voltage of the first node N11. Even though the fifth transistor M15 is turned on, the sixth transistor M16 is in the turn-off state and as a result, the voltage of the second node N12 is maintained at the logic low level voltage.

In a period between t19 to t20, the third clock signal CLK3 is applied as the logic low level voltage. The ninth transistor M19 is turned on by the third clock signal CLK3. In this case, since the second node N12 is maintained at the logic low level, the first transistor M11 and the seventh transistor M17 are in the turn-on state. The logic high level voltage transferred to the output terminal OUT is transferred to the first node N11 through the turned-on seventh transistor M11 and ninth transistor M19. As the logic high level voltage is transferred to the first node N11, the scan signal S[1] at the logic high level, which is output to the output terminal OUT by the third clock signal CLK3, is prevented from being swung.

Since the second scan driving block 210_2 uses the clock signal CLK2, CLK3, and CLK4 which are shifted from the clock signals CLK1, CLK2, and CLK3 used by the first scan driving block 210_1 by one duty, the second scan driving block 210_2 outputs the scan signal S[2] at the logic low level later than the first scan driving block 210_1 by one duty. Similarly, the third scan driving block 210_3 outputs the scan signal S[3] at the logic low level later than the second scan driving block 210_2 by one duty. By the above method, the plurality of scan driving blocks 210_1, 210_2, 210_3, 210_4, . . . output the scan signals S[1], S[2], S[3], S[4], . . . at the logic low level sequentially.

When the clock signal input to the third clock signal input terminal CK3 is to the logic low level voltage after the scan driving block outputs the scan signal at the logic low level, if the logic high level voltage is not applied to the first node N11, the voltage of the first node N11 is swung by the clock signal input to the third clock signal input terminal CK3. As the voltage of the first node N11 is swung by the coupling of the first node N11 and the output terminal OUT, the output signal of the output terminal OUT is swung.

However, when the clock signal at the logic low level is input to the third clock signal input terminal CK3 after the scan driving block outputs the scan signal at the logic low level, the provided scan driver turns on the seventh transistor M17 and the eighth transistor M18 to transfer the logic high level voltage to the first node N11. Accordingly, the voltage of the first node N11 may be prevented from being swung and the output signal of the output terminal OUT may be not influenced by the clock signal input to the third clock signal input terminal CK3.

In addition, since the provided scan driver does not use a transistor to which high on-bias voltage is applied, malfunction due to changes in characteristics of the transistor may be prevented. Further, the provided scan driver can be driven only by the four clock signals CLK1 to CLK4 and the output control signals GCK, and as a result, the number of wires can be decreased to simplify a structure of the scan driver, thereby acquiring a process gain.

Figure 6:
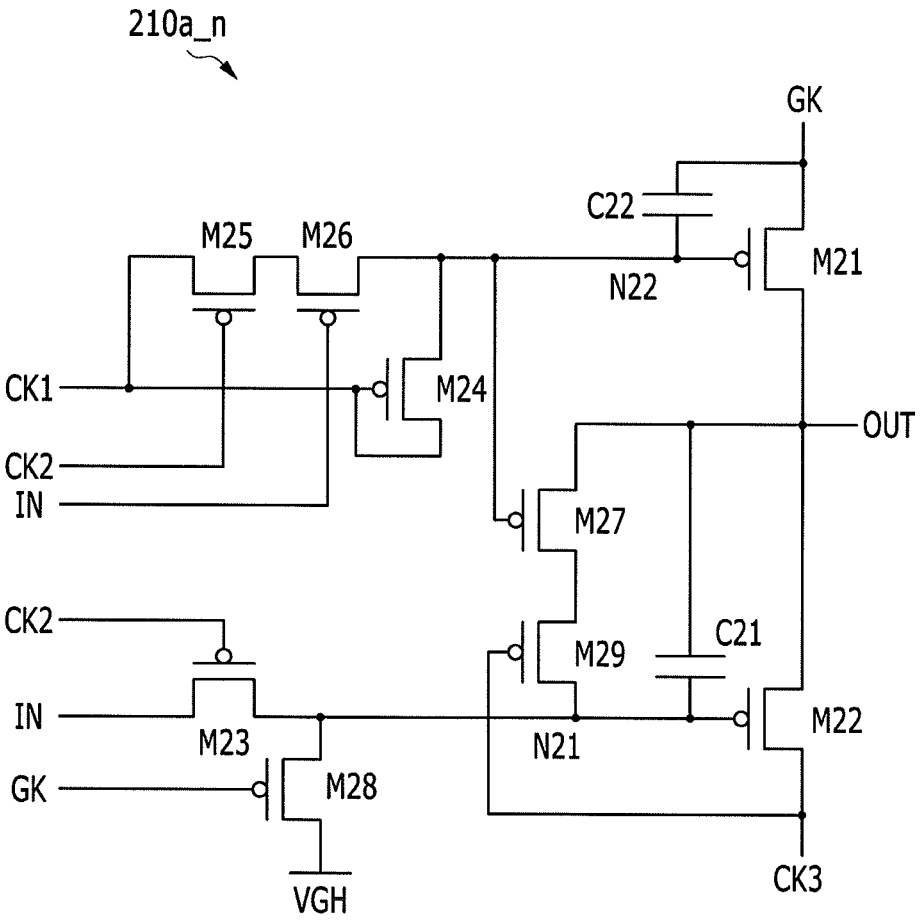
FIG. 6 is a circuit diagram illustrating a scan driving block included in the scan driver of FIG. 3 according to an exemplary embodiment.

FIG. 6 is a circuit diagram illustrating a scan driving block 210*a*_*n* included in the scan driver 200 of FIG. 3.

Referring to FIG. 6, the scan driving block 210*a*_*n* may include a plurality of transistors M21, M22, M23, M24, M25, M26, M27, M28, M29 and a plurality of capacitors C21, C22.

The first transistor M21 includes a gate electrode connected to a second node N22, one electrode connected to an output control signal input terminal GK, and another electrode connected to the output terminal OUT.

The second transistor M22 includes a gate electrode connected to a first node N21, one electrode connected to the third clock signal input terminal CK3, and another electrode connected to the output terminal OUT.

The third transistor M23 includes a gate electrode connected to the second clock signal input terminal CK2, one electrode connected to the driving signal input terminal IN, and another electrode connected to the first node N21.

The fourth transistor M24 includes a gate electrode connected to the first clock signal input terminal CK1, one electrode connected to the first clock signal input terminal CK1, and another electrode connected to the second node N22.

The fifth transistor M25 includes a gate electrode connected to the second clock signal input terminal CK2, one electrode connected to the first clock signal input terminal CK1, and another electrode connected to one electrode of the sixth transistor M26.

The sixth transistor M26 includes a gate electrode connected to the driving signal input terminal IN, one electrode connected to the other electrode of the fifth transistor M25, and another electrode connected to the second node N22.

The seventh transistor M27 includes a gate electrode connected to the second node N22, one electrode connected to the other electrode of the ninth transistor M29, and another electrode connected to the output terminal OUT.

The eighth transistor M28 includes a gate electrode connected to the output control signal input terminal GK, one electrode connected to the first power source voltage VGH, and another electrode connected to the first node N21. The first power source voltage VGH has logic high level voltage.

The ninth transistor M29 includes a gate electrode connected to the third clock signal input terminal CK3, one electrode connected to the first node N21, and another electrode connected to one electrode of the seventh transistor M27.

The first capacitor C21 includes one electrode connected to the first node N21 and the other electrode connected to the output terminal OUT. The second capacitor C22 includes one electrode connected to the output control signal input terminal GK and another electrode connected to the second node N22.

The scan driving block 210*a*_*n* is different from the scan driving block 210_*n* of FIG. 4 in that the first power source voltage VGH is connected to one electrode of the eighth transistor M28. The scan driving block 210*a*_*n* is the same as the scan driving block 210_*n* of FIG. 4 in that the logic high level voltage is transferred to the first node N21 through the eighth transistor M28 when the output control signal GCK is applied at the logic low level.

Figure 7:
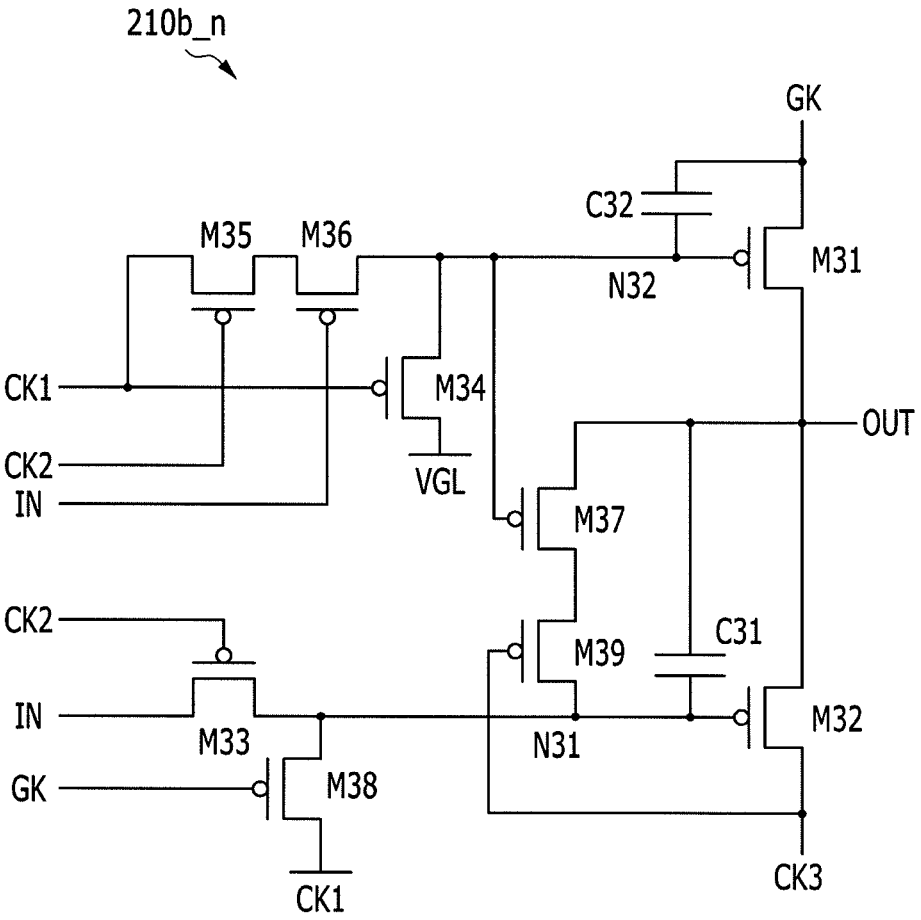
FIG. 7 is a circuit diagram illustrating a scan driving block included in the scan driver of FIG. 3 according to an exemplary embodiment.

FIG. 7 is a circuit diagram illustrating a scan driving block 210*b*_*n* included in the scan driver of FIG. 3 according to another exemplary embodiment.

Referring to FIG. 7, the scan driving block 210*b*_*n* includes a plurality of transistors M31, M32, M33, M34, M35, M36, M37, M38, and M39 and a plurality of capacitors C31 and C32.

The first transistor M31 includes a gate electrode connected to a second node N32, one electrode connected to an output control signal input terminal GK, and another electrode connected to the output terminal OUT.

The second transistor M32 includes a gate electrode connected to a first node N31, one electrode connected to the third clock signal input terminal CK3, and another electrode connected to the output terminal OUT.

The third transistor M33 includes a gate electrode connected to the second clock signal input terminal CK2, one electrode connected to the driving signal input terminal IN, and another electrode connected to the first node N31.

The fourth transistor M34 includes a gate electrode connected to the first clock signal input terminal CK1, one electrode connected to the second power source voltage VGL, and another electrode connected to the second node N32.

The fifth transistor M35 includes a gate electrode connected to the second clock signal input terminal CK2, one electrode connected to the first clock signal input terminal CK1, and another electrode connected to one electrode of the sixth transistor M36.

The sixth transistor M36 includes a gate electrode connected to the driving signal input terminal IN, one electrode connected to the other electrode of the fifth transistor M35, and another electrode connected to the second node N32.

The seventh transistor M37 includes a gate electrode connected to the second node N32, one electrode connected to the other electrode of the ninth transistor M39, and another electrode connected to the output terminal OUT.

The eighth transistor M38 includes a gate electrode connected to the output control signal input terminal GK, one electrode connected to the first clock signal input terminal CK1, and another electrode connected to the first node N31. Herein, one electrode of the eighth transistor M38 is connected to the first clock signal input terminal CK1, and another electrode of the eighth transistor M38 may be connected with any one of the second clock signal input terminal CK2 and/or the third clock signal input terminal CK3.

The ninth transistor M39 includes a gate electrode connected to the third clock signal input terminal CK3, one electrode connected to the first node N31, and another electrode connected to one electrode of the seventh transistor M37.

The first capacitor C31 includes one electrode connected to the first node N31 and the other electrode connected to the output terminal OUT. The second capacitor C32 includes one electrode connected to the output control signal input terminal GK and another electrode connected to the second node N32.

The scan driving block is different from the scan driving block of FIG. 4 in that the second power source voltage VGL is connected to one electrode of the fourth transistor M34. The scan driving block is the same as the scan driving block of FIG. 4 in that the logic low level voltage is transferred to the second node N32 through the fourth transistor M34 when the signal input to the first clock signal input terminal CK1 is applied at the logic low level.

Figure 8:
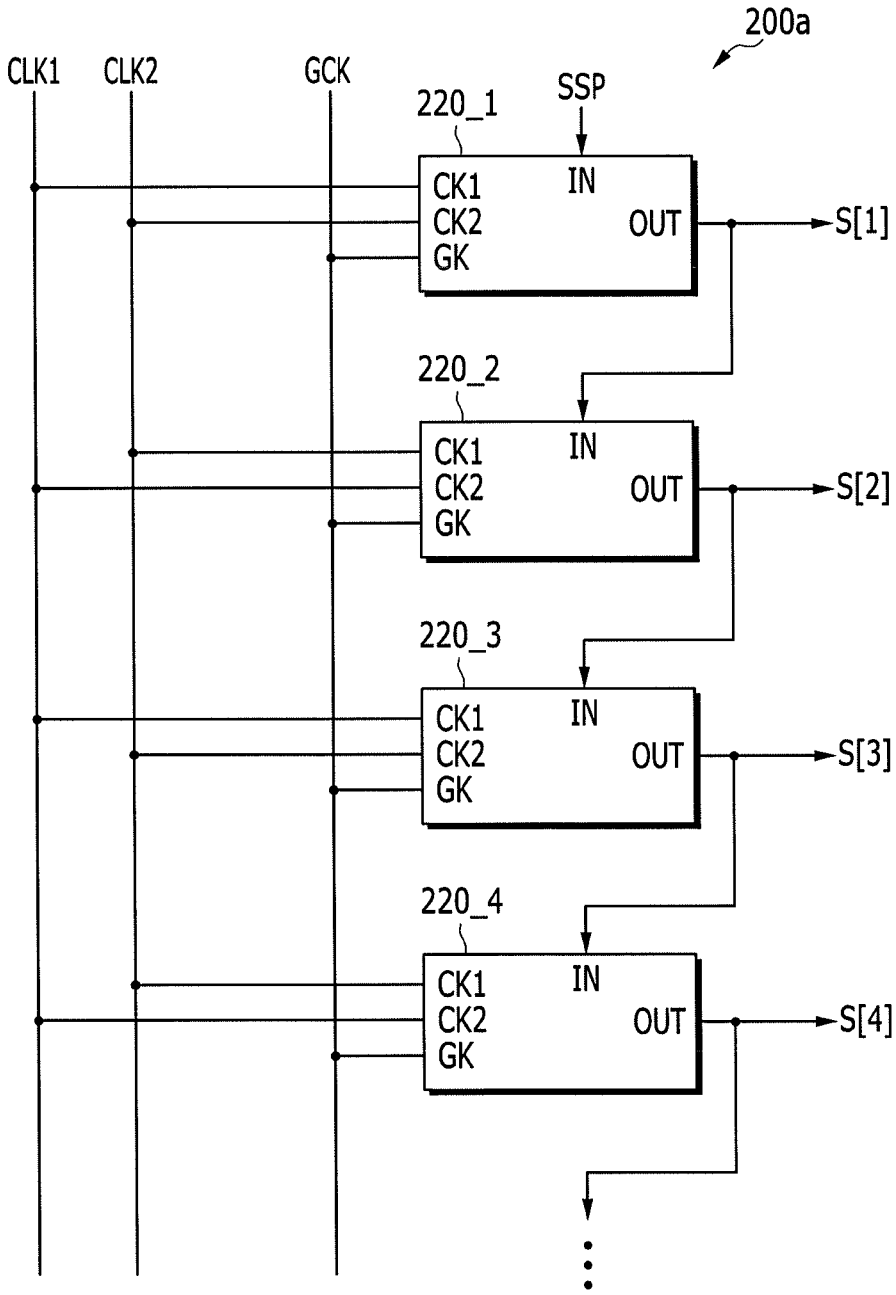
FIG. 8 is a block diagram illustrating a configuration of a scan driver according to an exemplary embodiment.

FIG. 8 is a block diagram illustrating a configuration of a scan driver 200*a* according to another exemplary embodiment. Referring to FIG. 8, the scan driver 200*a* includes a plurality of scan driving blocks 220_1, 220_2, 220_3, 220_4, . . . that arranged sequentially. The scan driving blocks 220_1, 220_2, 220_3, 220_4, . . . generate scan signals S[1], S[2], S[3], S[4], . . . transferred to a plurality of scan lines S1 to Sn by receiving input signals, respectively.

Each of the plurality of scan driving blocks 220_1, 220_2, 220_3, 220_4, . . . includes a first clock signal input terminal CK1, a second clock signal input terminal CK2, an output control signal input terminal GK, a driving signal input terminal IN, and an output terminal OUT.

The first clock signal CLK1 is input into the first clock signal input terminals CK1 of odd numbered scan driving blocks 220_1, 220_3, . . . among the plurality of scan driving blocks 220_1, 220_2, 220_3, 220_4, . . . and the second clock signal CLK2 is input into the second clock signal input terminals CK2. In addition, the second clock signal CLK2 is input into the first clock signal input terminals CK1 of even numbered scan driving blocks 220_2, 220_4, . . . among the plurality of scan driving blocks 220_1, 220_2, 220_3, 220_4, . . . and the first clock signal CLK1 is input into the second clock signal input terminals CK2.

The output control signals GCK are input into output control signal input terminals GK of the plurality of scan driving blocks 220_1, 220_2, 220_3, 220_4, . . . .

Scan signals of the previously arranged scan driving blocks are input into drive signal input terminals IN of the plurality of scan driving blocks 220_1, 220_2, 220_3, 220_4, . . . . That is, scan signals of the previously arranged even numbered scan driving blocks are input into driving signal input terminals IN of the odd numbered scan driving blocks. Scan signals of the previously arranged odd numbered scan driving blocks are input into drive signal input terminals IN of the even numbered scan driving blocks. In other words, when the plurality of scan driving blocks 220_1, 220_2, 220_3, 220_4, . . . sequentially output the scan signals, a scan signal S[K−1] of the k−1-th scan driving block 220_*k*−1 is input into the diving signal input terminal IN of the k-th scan driving block 220_*k*. In this case, a scan start signal SSP is input into the driving signal input terminal IN of the first scan driving block 220_1.

The scan driving blocks 220_1, 220_2, 220_3, 220_4, . . . each output the scan signals S[1], S[2], S[3], S[4], . . . generated according to the signals input into the first clock signal input terminal CK1, the second signal input terminal CK2, the output control signal input terminal GK, and the driving signal input terminal IN, to the output terminals OUT.

The first scan driving block 220_1 transfers the scan signal S[1] generated by receiving the scan start signal SSP to the first scan line S1 and the driving signal input terminals IN of the second scan driving block 220_2. The k-th arranged scan driving block 220_*k* outputs the scan signal S[k] generated by receiving the scan signal S[k−1] output from the k−1-th arranged scan driving block 220_*k*−1 (1<k<=n).

Figure 9:
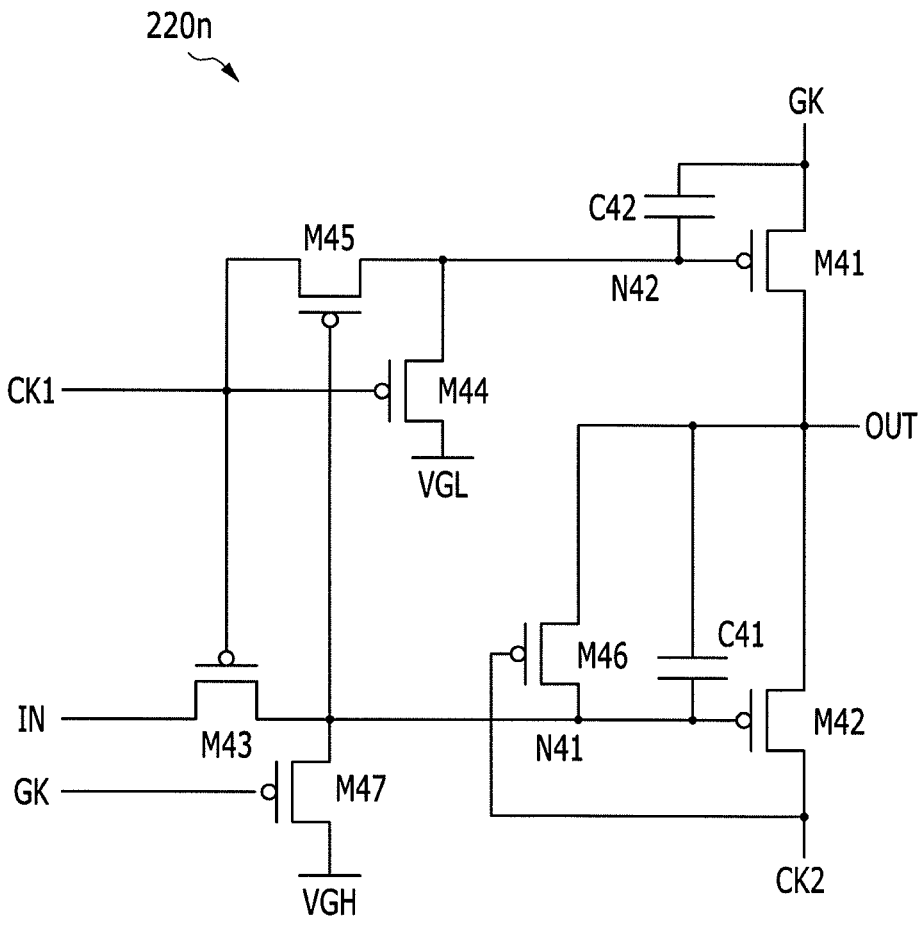
FIG. 9 is a circuit diagram illustrating a scan driving block included in the scan driver of FIG. 8 according to an exemplary embodiment.

FIG. 9 is a circuit diagram illustrating a scan driving block 220_*n* included in the scan driver of FIG. 8 according to an exemplary embodiment.

Referring to FIG. 9, the scan driving block 220_*n* includes a plurality of transistors M41, M42, M43, M44, M45, M46, M47 and a plurality of capacitors C41, C42.

The first transistor M41 includes a gate electrode connected to a second node N42, one electrode connected to the output control signal input terminal GK, and another electrode connected to the output terminal OUT.

The second transistor M42 includes a gate electrode connected to a first node N41, one electrode connected to the second clock signal input terminal CK2, and another electrode connected to the output terminal OUT.

The third transistor M43 includes a gate electrode connected to the first clock signal input terminal CK1, one electrode connected to the driving signal input terminal IN, and another electrode connected to the first node N41.

The fourth transistor M44 includes a gate electrode connected to the first clock signal input terminal CK1, one electrode connected to second power source voltage VGL, and another electrode connected to the second node N42.

The fifth transistor M45 includes a gate electrode connected to the first node N41, one electrode connected to the first clock signal input terminal CK1, and another electrode connected to the second node N42.

The sixth transistor M46 includes a gate electrode connected to the second clock signal input terminal CK2, one electrode connected to the first node N41, and another electrode connected to the output terminal OUT.

The seventh transistor M47 includes a gate electrode connected to the output control signal input terminal GK, one electrode connected to first power source voltage VGH, and another electrode connected to the first node N41.

The first capacitor C41 includes one electrode connected to the first node N41 and the other electrode connected to the output terminal OUT. The second capacitor C42 includes one electrode connected to the output control signal input terminal GK and another electrode connected to the second node N42.

In the exemplary embodiment of FIG. 9, the plurality of transistors M41, M42, M43, M44, M45, M46, M47 are p-channel field effect transistors. In such embodiments, a gate-on voltage that turns on the plurality of transistors M41, M42, M43, M44, M45, M46, M47 is logic low level voltage and a gate-off voltage that turns off the plurality of transistors M41, M42, M43, M44, M45, M46, M47 is logic high level voltage. Herein, the plurality of transistors M41, M42, M43, M44, M45, M46, M47 are the p-channel field effect transistors, but the plurality of transistors M41, M42, M43, M44, M45, M46, M47 may be n-channel field effect transistors. The gate-on voltage that turns on the n-channel field effect transistors is logic high level voltage and the gate-off voltage that turns off the n-channel field effect transistors is logic low level voltage.

Figure 10:
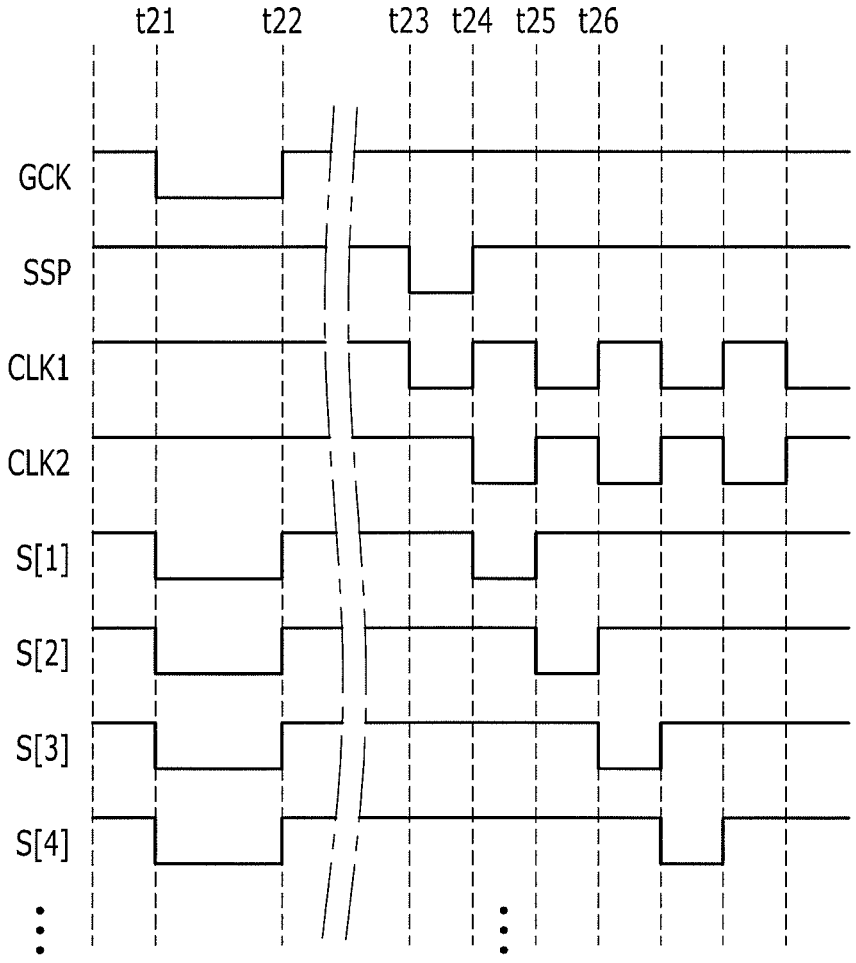
FIG. 10 is a timing diagram illustrating a driving method of the scan driver of FIG. 8.

FIG. 10 is a timing diagram illustrating a driving method of the scan driver 200*a* of FIG. 8.

Referring to FIGS. 8 to 10, the scan driver 200*a* concurrently outputs scan signals of gate-on voltage to a plurality of scan lines S1 to Sn during the resetting period (a) and the compensating of the threshold voltage period (b) and sequentially outputs the scan signals of gate-on voltage to the plurality of scan lines S1 to Sn during the scanning period (c).

A period t21 to t22 represents a period of any one of the resetting (a) and the compensating of the threshold voltage (b) during which the scan signals of gate-on voltage are output to the plurality of scan lines S1 to Sn concurrently. In the period t21 to t22, the output control signal GCK is applied as the logic low level voltage and the scan start signal SSP, the first clock signal CLK1, and the second clock signal CLK2 are applied as the logic high level voltage. The third transistor M43, the fourth transistor M44, and the sixth transistor M46 are turned off by a logic high level signal. The seventh transistor M47 is turned on by an output control signal GCK. The first power source voltage VGH is transferred to the fifth transistor M45 through the turned on seventh transistor M47, and as a result, the fifth transistor M45 is turned off.

In a period t21 to t22, the second node N42 connected to the other electrode of the second capacitor C42 and the gate electrode of the first transistor M41 is in a floating state. When the output control signal GCK decreases from the logic high level voltage to the logic low level voltage at a time t21, the voltage of the second node N42 in the floating state decreases to the logical low level by coupling depending on a change in the voltage of the output control signal GCK. As the voltage of the second node N42 decreases to the logic low level, the first transistor M41 is turned on. As the first transistor M41 is turned on, the output control signal GCK at the logic low level is transferred to the output terminal OUT through the first transistor M41.

As such, the plurality of scan driving blocks 220_1, 220_2, 220_3, 220_4, . . . output the scan signals S[1], S[2], S[3], S[4], . . . at the logic low level concurrently.

A period after t23 is a period of the scanning (c) during which the scan signals of the gate-on voltage are sequentially output to the plurality of scan lines S1 to Sn. In the period after t23, the output control signal GCK is applied as the logic high level voltage.

The scan start signal SSP is applied as the logic low level voltage during a period t23 to t24. The voltage of the first clock signal CLK1 repetitively changes to the logic low level and the logic high level starting from the period t23 to t24. The voltage of the second clock signal CLK2 repetitively changes to the logic low level and the logic high level starting from the period t24 to t25. That is, the second clock signal CLK2 is a signal which is shifted from the first clock signal CLK1 by a duty of the first clock signal CLK1. The duty of the clock signal represents a time period during which a voltage for turning on the transistors included in the scan driving blocks is applied.

In the period t23 to t24, the scan start signal SSP at the logic low level is applied to the driving signal input terminal IN of the first scan driving block 220_1 and the first lock signal CLK1 at the logic low level is applied to the first clock signal input terminal CK1. The third transistor M43 and the fourth transistor M44 are turned on. The scan start signal SSP at the logic low level is transferred to the first node N41 and the second power source voltage VGL is transferred to the second node N42. The first transistor M41 and the second transistor M42 are turned on. The logic high level voltage is transferred to the output terminal OUT. In this case, the first capacitor C41 is charged by a voltage difference between the logic low level voltage of the first node N41 and the logic high level voltage of the output terminal OUT.

In a period t24 to t25, the first clock signal CLK1 at the logic high level is applied to the first clock signal input terminal CK1 of the first scan driving block 220_1 and the second clock signal CLK2 at the logic low level is applied to the second clock signal input terminal CK2. The third transistor M43 and the fourth transistor M44 are turned ff and the sixth transistor M46 is turned on. The second transistor M42 is fully turned on by a bootstrap through the first capacitor C41. The logic low level voltage is transferred to the output terminal OUT through the second transistor that is turned on. In this case, the voltage of the first node N41 decreases to the logic low level voltage by coupling. The fifth transistor M45 is turned on by the logic low level voltage of the first node N41 and the logic high level voltage is transferred to the second node N42. The first transistor M41 is turned off by the logic high level voltage of the second node N42.

As a result, the first scan driving block 220_1 outputs the scan signal S[1] at the logic low level.

In the period t24 to t25, the scan signal S[1] at the logic low level of the first scan driving block 220_1 is applied to the driving signal input terminal IN of the second scan driving block 220_2. The second clock signal CLK2 at the logic high level is applied to the first clock signal input terminal CK1 of the second scan driving block 220_2 and the first clock signal CLK1 at the logic high level is applied to the second clock signal input terminal CK2. The second scan driving block 220_2 operates similarly as the operation in the period t23 to t24 of the first scan driving block 220_1 to charge the first capacitor C41 with the voltage difference between the logic low level voltage of the first node N41 and the logic high level voltage of the output terminal OUT.

In a period t25 to t26, the second clock signal CLK2 at the logic high level is applied to the first clock signal input terminal CK1 of the second scan driving block 220_2 and the first clock signal CLK1 at the logic low level is applied to the second clock signal input terminal CK2. The second scan driving block 220_2 operates similarly as the operation in the period t24 to t25 of the first scan driving block 220_1 to output the scan signal S[2] at the logic low level.

In the period t25 to t26, the first clock signal CLK1 at the logic low level is input to the first clock signal input terminal CK1 of the first scan driving block 220_1 and the second clock signal CLK2 at the logic high level is input to the second clock signal input terminal CK2. The third transistor M43 and the fourth transistor M44 are turned on. The logic high level voltage is transferred to the first node N41 and the second power source voltage VGL is transferred to the second node N42. The second transistor M42 is turned off by the logic high level voltage of the first node N41. The first transistor M41 is turned on by the logic low level voltage of the second node N42 and the logic high level voltage is transferred to the output terminal OUT. In this case, the second capacitor C42 is charged by a voltage difference between the logic low level voltage of the second node N42 and the logic high level voltage of the output control signal input terminal GK.

In a period t26 to t27, the first clock signal CLK1 at the logic high level is input to the first clock signal input terminal CK1 of the first scan driving block 220_1 and the second clock signal CLK2 at the logic low level is input to the second clock signal input terminal CK2. The third transistor M43 and the fourth transistor M44 are turned off. The first transistor M41 maintains a turn-on state by the voltage charged in the second capacitor C42 and transfers the output control signal GCK at the logic high level to the output terminal OUT. The sixth transistor M46 is turned on by the second clock signal CLK2 at the logic low level and the logic high level voltage of the output terminal OUT is transferred to the first node N41. The second transistor M42 maintains a turn-off state by the logic high level voltage of the first node N41.

As such, after the scan signal at the logic low level is output, the logic high level voltage is transferred to the first node N41 according to the clock signal input into the first clock signal input terminal CK1 and the clock signal input into the second clock signal input terminal CK2, thereby preventing the scan signal S[1] of the first scan driving block 220_1 from being wobbled by the clock signal applied to the second clock signal input terminal CK2.

By the above-mentioned method, the plurality of scan driving blocks 220_1, 220_2, 220_3, 220_4, . . . output the scan signals S[1], S[2], S[3], S[4], . . . at the logic low level sequentially.

If the logic high level voltage is not transferred to the first node N41 after the scan driving block outputs the scan signal at the logic low level, the voltage of the first node N41 is wobbled by voltage variations of the clock signal input into the second clock signal input terminal CK2. As the voltage of the first node N41 is wobbled by coupling of the first node N41 and the output terminal OUT, an output signal of the output terminal OUT is wobbled.

However, in embodiments of the scan driver 200*a*, after the scan driving block outputs the scan signal at the logic low level, the logic high level voltage is transferred to the first node N41 according to the clock signal input into the first clock signal input terminal CK1 and the clock signal input into the second clock signal input terminal CK2, thereby preventing the output signal of the scan driving block 220*n* from being wobbled and the output signal of the output terminal OUT from being influenced by the clock signal input to the second clock signal input terminal CK2.

Moreover, one or more embodiments of the scan driver 200*a* may be driven only by two clock signals CLK1 and CLK2, the output control signal GCK, and two power sources, and thus, a number of wires can be reduced, a process gain can be acquired by simplifying the structure of the scan driver 200*a*.

Figure 11:
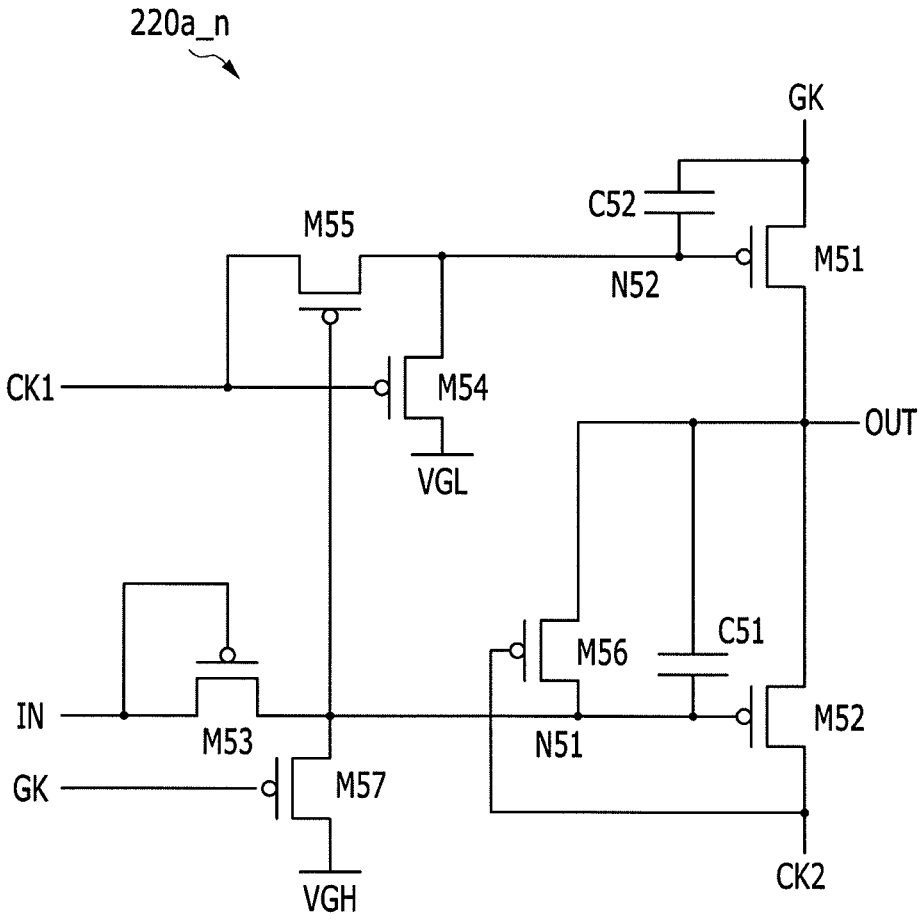
FIG. 11 is a circuit diagram illustrating a scan driving block included in the scan driver of FIG. 8 according to an exemplary embodiment.

FIG. 11 is a circuit diagram illustrating a scan driving block 220*a*_*n* employable by the scan driver 200*a* of FIG. 8 according to another exemplary embodiment.

Referring to FIG. 11, the scan driving block 200*a*_*n* includes a plurality of transistors M51, M52, M53, M54, M55, M56, M57 and a plurality of capacitors C51, C52.

The first transistor M51 includes a gate electrode connected to a second node N52, one electrode connected to the output control signal input terminal GK, and another electrode connected to the output terminal OUT.

The second transistor M52 includes a gate electrode connected to a first node N51, one electrode connected to the second clock signal input terminal CK2, and another electrode connected to the output terminal OUT.

The third transistor M53 includes a gate electrode connected to a driving signal input terminal IN, one electrode connected to the driving signal input terminal IN, and another electrode connected to the first node 51.

The fourth transistor M54 includes a gate electrode connected to the first clock signal input terminal CK1, one electrode connected to second power source voltage VGL, and another electrode connected to the second node N52.

The fifth transistor M55 includes a gate electrode connected to the first node N51, one electrode connected to the first clock signal input terminal CK1, and another electrode connected to the second node N52.

The sixth transistor M56 includes a gate electrode connected to the second clock signal input terminal CK2, one electrode connected to the first node N51, and another electrode connected to the output terminal OUT.

The seventh transistor M57 includes a gate electrode connected to the output control signal input terminal GK, one electrode connected to first power source voltage VGH, and another electrode connected to the first node N51.

The first capacitor C51 includes one electrode connected to the first node N41 and the other electrode connected to the output terminal OUT. The second capacitor C52 includes one electrode connected to the output control signal input terminal GK and another electrode connected to the second node N42.

Compared with the scan driving block 220*n* of FIG. 9, the scan driving block 220*a*_*n* of FIG. 11 is different from the scan driving block 220_*n* of FIG. 9 in that the gate electrode of the third transistor M53 is connected to the driving signal input terminal IN. When the scan start signal SSP or scan signal at the logic low level is applied to the driving signal input terminal IN, the scan driving block 220*a*_*n* of FIG. 11 is the same as the scan driving block 220_*n* of FIG. 9 in that the logic low level voltage is transferred to the first node N51 through the third transistor M53.

Figure 12:
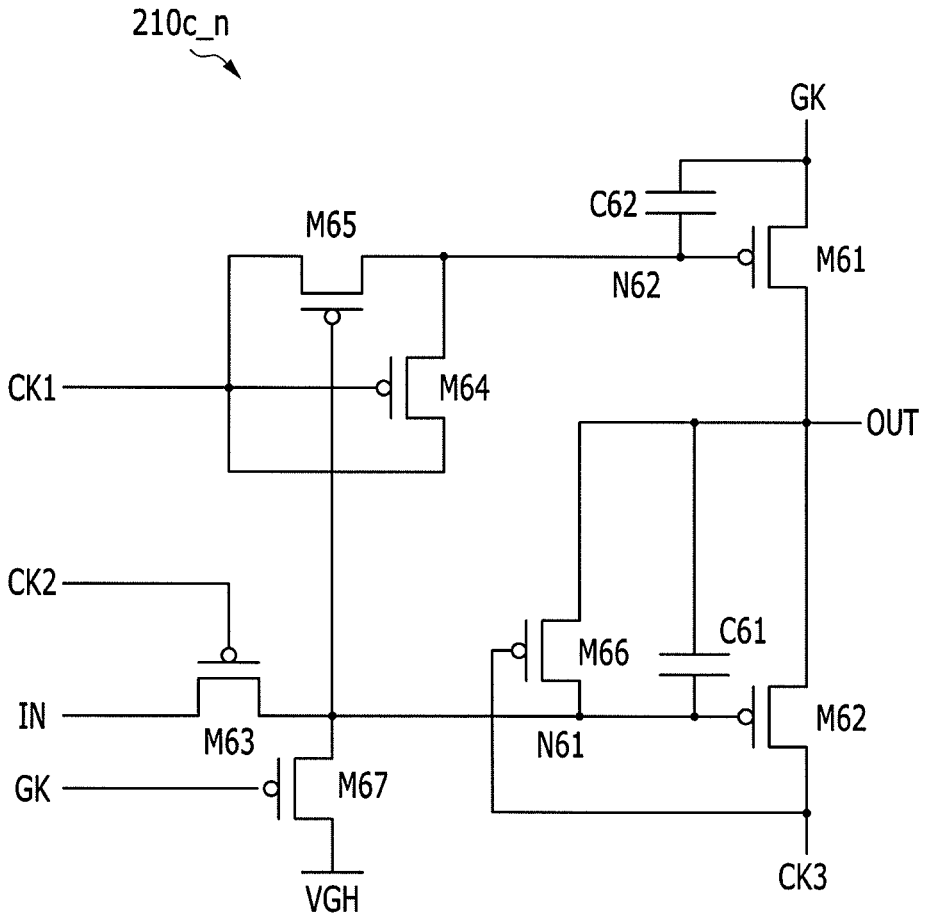
FIG. 12 is a circuit diagram illustrating a scan driving block included in the scan driver of FIG. 3 according to an exemplary embodiment.

FIG. 12 is a circuit diagram illustrating a scan driving block 210*c*_*n* employable in the scan driver 200 of FIG. 3 according to another exemplary embodiment.

More particularly, referring to FIG. 12, the scan driver 200 of FIG. 3 employing one or more of the scan driving blocks 210_*n*, 210*a*_*n*, 210*b*_*n* of FIGS. 4, 6, and 7 is driven by four clock signals each having a repeating 4 duty cycle including 1 duty period at a logic low level and 3 duty periods at a logic high level.

Referring to FIG. 12, in embodiments including the scan driver 200 of FIG. 3 employing the scan driving block 210*c*_*n*, the scan driver 200 of FIG. 3 may be driven by four clock signals CLK1, CLK2, CLK3, and CLK4 each having a repeating 2 duty cycle and each including 1 duty period at a logic low level and 1 duty period at a logic high level.

The scan driving block include a plurality of transistors M61, M62, M63, M64, M65, M66, M67 and a plurality of capacitors C61, C62.

The first transistor M61 includes a gate electrode connected to a second node N62, one electrode connected to the output control signal input terminal GK, and another electrode connected to the output terminal OUT.

The second transistor M62 includes a gate electrode connected to a first node N61, one electrode connected to the third clock signal input terminal CK3, and another electrode connected to the output terminal OUT.

The third transistor M63 includes a gate electrode connected to the second clock signal input terminal CK2, one electrode connected to the driving signal input terminal IN, and another electrode connected to the first node N61.

The fourth transistor M64 includes a gate electrode connected to the first clock signal input terminal CK1, one electrode connected to the first clock signal input terminal CK1, and another electrode connected to the second node N62.

The fifth transistor M65 includes a gate electrode connected to the first node N61, one electrode connected to the first clock signal input terminal CK1, and another electrode connected to the second node N62.

The sixth transistor M66 includes a gate electrode connected to the third clock signal input terminal CK3, one electrode connected to the first node N61, and another electrode connected to the output terminal OUT.

The seventh transistor M67 includes a gate electrode connected to the output control signal input terminal GK, one electrode connected to first power source voltage VGH, and another electrode connected to the first node N61.

The first capacitor C61 includes one electrode connected to the first node N61 and the other electrode connected to the output terminal OUT. The second capacitor C62 includes one electrode connected to the output control signal input terminal GK and another electrode connected to the second node N62.

Figure 13:
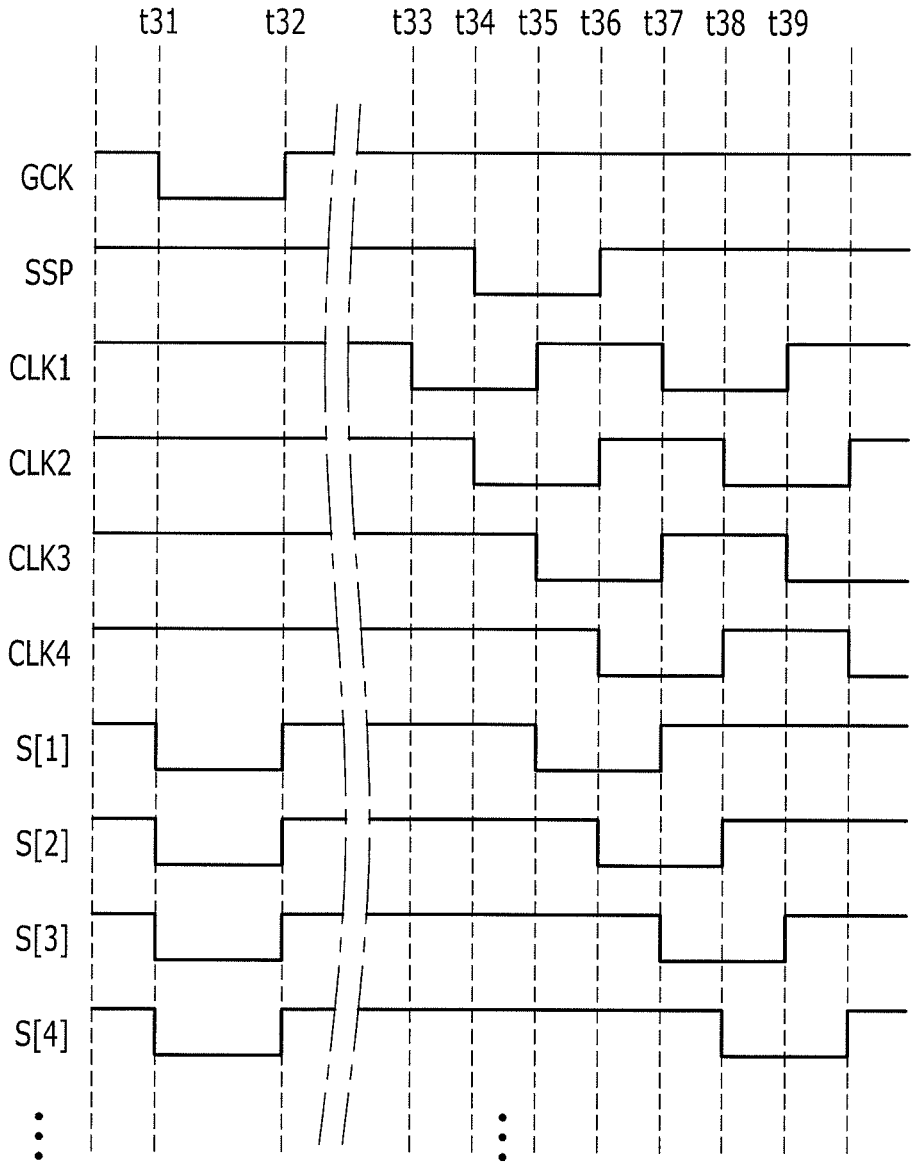
FIG. 13 is a timing diagram illustrating a driving method of the scan driver of FIG. 3 including the scan driving block of FIG. 12.

FIG. 13 is a timing diagram illustrating a driving method of the scan driver 200 of FIG. 3 including the scan driving block 210_*c* of FIG. 12.

Referring to FIGS. 3, 12, and 13, a period t31 to t32 represents a period of any one of the resetting (a) and the compensating of the threshold voltage (b) in which the scan signals of gate-on voltage are output to the plurality of scan lines S1 to Sn concurrently. Since a driving operation in the period t31 to t32 is the same as that in the period t21 to t22 described in FIG. 10, the description of the driving operation will not be repeated.

A period after t33 represents a period of the scanning (c) in which the scan signals of the gate-on voltage are sequentially output to the plurality of scan lines S1 to Sn. In the period after t33, the output control signal GCK is applied as the logic high level voltage. In the period in which the scan signals of gate-on voltage are sequentially output to the plurality of scan lines S1 to Sn, clock signals which are shifted from the clock signals input into the first clock signal input terminals CK1 of the plurality of scan driving blocks 210_1, 210_2, 210_3, 210_4, . . . by ½ duty are input into the second clock signal input terminals CK2 and clock signals which are shifted from the clock signals input into the second clock signal input terminals CK2 by ½ duty are input into the third clock signal input terminals CK3.

In a period t34 to t35, the scan start signal SSP at the logic low level is applied to the driving signal input terminal IN of the first scan driving block 210_1, the first lock signal CLK1 at the logic low level is applied to the first clock signal input terminal CK1, and the second clock signal CLK2 at the logic low level is applied to the second clock signal input terminal CK2. The third transistor M63 and the fourth transistor M64 are turned on. The scan start signal SSP at the logic low level is transferred to the first node N61 and the first clock signal CLK1 at the logic low level is transferred to the second node N62. The first transistor M61 and the second transistor M62 are turned on. The logic high level voltage is transferred to the output terminal OUT. In this case, the first capacitor C61 is charged by a voltage difference between the logic low level voltage of the first node N61 and the logic high level voltage of the output terminal OUT. The second capacitor C62 is charged by a voltage difference between the logic low level voltage of the second node N62 and the logic high level voltage of the output control signal input terminal GK.

In a period t35 to t36, the first clock signal CLK1 at the logic high level is applied to the first clock signal input terminal CK1 of the first scan driving block 210_1, the second clock signal CLK2 at the logic low level is applied to the second clock signal input terminal CK2, and the third clock signal CLK3 at the logic low level is applied to the third clock signal input terminal CK3. The fourth transistor M64 is turned off and the third transistor M63 is turned on. The sixth transistor M66 is tuned on. The logic low level voltage is transferred to the first node N61 and the second transistor M62 is turned on. The third clock signal CLK3 at the logic low level is transferred to the output terminal OUT through the second transistor M62 which is turned on, and as a result, the scan signal S[1] at the logic low level is output. In this case, the fifth transistor M65 is turned on by the logic low level voltage of the first node N61 and the logic high level voltage is transferred to the second node N62. The first transistor M61 is turned off by the logic high level voltage of the second node N62.

In a period t36 to t37, the first clock signal CLK1 at the logic high level is applied to the first clock signal input terminal CK1 of the first scan driving block 210_1, the second clock signal CLK2 at the logic high level is applied to the second clock signal input terminal CK2, and the third clock signal CLK3 at the logic low level is applied to the third clock signal input terminal CK3. The fourth transistor M64 is turned off and the third transistor M63 is turned off. The second transistor M62 is turned on by the voltage charged in the first capacitor C61 and the third clock signal CLK3 at the logic low level is transferred to the output terminal OUT to output the san signal S[1] at the logic low level.

In a period t37 to t38, the first clock signal CLK1 at the logic low level is applied to the first clock signal input terminal CK1 of the first scan driving block 210_1, the second clock signal CLK2 at the logic high level is applied to the second clock signal input terminal CK2, and the third clock signal CLK3 at the logic high level is applied to the third clock signal input terminal CK3. The fourth transistor M64 is turned on and the logic low level voltage is transferred to the second node N62. The first transistor M61 is turned on by the logic low level voltage of the second node N62 and the logic high level voltage is transferred to the output terminal OUT. The logic high level voltage of the output terminal OUT is transferred to the first node N61 through the sixth transistor M66 which is turned on by the voltage charged in the first capacitor 61. The second transistor M62 is turned off by the logic high level voltage of the first node N61.

In a period t38 to t39, the first clock signal CLK1 at the logic low level is applied to the first clock signal input terminal CK1 of the first scan driving block 210_1, the second clock signal CLK2 at the logic low level is applied to the second clock signal input terminal CK2, and the third clock signal CLK3 at the logic high level is applied to the third clock signal input terminal CK3. The third transistor M63 is turned on and the logic high level voltage is transferred to the first node N61. The logic low level voltage is transferred to the second node N62 and the first transistor M61 is turned on.

As such, after the scan signal at the logic low level is output, the logic high level voltage is transferred to the first node N61 according to the clock signal input into the second clock signal input terminal CK2 and the clock signal input into the third clock signal input terminal CK3, thereby preventing the scan signal S[1] of the first scan driving block 210_1 from being wobbled by the clock signal applied to the third clock signal input terminal CK3.

By the above-mentioned method, the plurality of scan driving blocks 210_1, 210_2, 210_3, 210_4, . . . sequentially output the scan signals S[1], S[2], S[3], S[4], . . . at the logic low level.

Meanwhile, in the scan driving block of FIG. 12, the sixth transistor M65 is turned on according to the clock signal input into the second clock signal input terminal CK2 and the signal input into the driving signal input terminal IN, and as a result, the clock signal input into th first clock signal input terminal CK1 is transferred to the second node N62. In addition, in the scan driving block of FIG. 4, the fifth transistor M15 and the sixth transistor M16 are turned on according to the clock signal input into the second clock signal input terminal CK2 and the signal input into the driving signal input terminal IN, and as a result, the clock signal input into the first clock signal input terminal CK1 is transferred to the second node N12. That is, the scan driving block of FIG. 4 operates similarly as the scan driving block of FIG. 12. Accordingly, the scan driving block of FIG. 4 may operate as described in FIG. 13.

The drawings and the detailed description described above are examples for the present invention and provided to explain the present invention and the scope of the present invention described in the claims is not limited thereto. Therefore, it is understood that various modifications and other equivalent exemplary embodiments may be possible by those who are skilled in the art. Accordingly, the actual scope of the present invention must be determined by the spirit of the appended claims.

DESCRIPTION OF SYMBOLS

100: Signal controller
200: Scan driver
210: Scan driving block
300: Data driver
500: Display unit

What is claimed is:

1. A scan driver, comprising:

a plurality of scan driving blocks arranged sequentially, each of the plurality of scan driving blocks including:

a first node configured to receive a signal input into a driving signal input terminal in accordance with a clock signal input into a second clock signal input terminal;

a second node configured to receive a clock signal input into a first clock signal input terminal;

a first transistor including a gate electrode connected to the second node, a first electrode configured to receive an output control signal, and a second electrode connected to an output terminal;

a second transistor including a gate electrode connected to the first node, a first electrode connected to a third clock signal input terminal, and a second electrode connected to the output terminal; and a third transistor including a gate electrode connected to the third clock signal input terminal, a first electrode connected to the first node, and a second electrode connected the output terminal, wherein the output control signal varies between at least two voltage levels.

2. The scan driver of claim 1, further comprising:

a first capacitor including a first electrode connected to the first node and a second electrode connected to the output terminal.

3. The scan driver of claim 2, further comprising:

a second capacitor including a first electrode configured to receive the output control signal and a second electrode connected to the second node.

4. The scan driver of claim 3, further comprising:

a fourth transistor including a gate electrode connected to the first clock signal input terminal and a first electrode connected to the second node and configured to transfer a gate-on voltage to the second node.

5. The scan driver of claim 4, wherein: the fourth transistor further includes a second electrode connected to the first clock signal input terminal.

6. The scan driver of claim 4, wherein: the fourth transistor further includes a second electrode connected to power source voltage having a logic low level.

7. The scan driver of claim 4, further comprising:

a fifth transistor including a gate electrode connected to the second clock signal input terminal, a first electrode connected to the driving signal input terminal, and a second electrode connected to the first node.

8. The scan driver of claim 7, further comprising:

a sixth transistor configured to transfer a gate-off voltage to the first node according to the output control signal.

9. The scan driver of claim 8, wherein: the sixth transistor includes a first electrode connected to any one of the first clock signal input terminal, the second clock signal input terminal, and the third clock signal input terminal, a gate electrode into which the output control signal is input, and a second electrode connected to the first node.

10. The scan driver of claim 8, wherein: the sixth transistor includes a gate electrode into which the output control signal is input, a first electrode connected to a power source voltage having a logic high level, and a second electrode connected to the second node.

11. The scan driver of claim 8, further comprising:

a seventh transistor configured to transfer the clock signal, which is input to the first clock signal input terminal according to the signal input into the driving signal input terminal, to the second node.

12. The scan driver of claim 11, wherein: the seventh transistor includes a gate electrode connected to the driving signal input terminal, a first electrode to which the clock signal input to the first clock signal input terminal is applied, and a second electrode connected to the second node.

13. The scan driver of claim 12, wherein: an eighth transistor including a gate electrode connected to the second clock signal input terminal, a first electrode connected to the first clock signal input terminal, and a second electrode connected to the first electrode of the seventh transistor.

14. The scan driver of claim 11, wherein: the seventh transistor includes a gate electrode connected to the first node, a first electrode connected to the first clock signal input terminal, and a second electrode connected to the second node.

15. The scan driver of claim 11, further comprising:

a ninth transistor including a gate electrode connected to the second node, a first electrode connected to the second electrode of the third transistor, and a second electrode connected to the output terminal.

16. The scan driver of claim 1, wherein:

a first clock signal is input into the first clock signal input terminal of any one first scan driving block among the plurality of scan driving blocks, a second clock signal is input into the second clock signal input terminal thereof, and a third clock signal is input into the third clock signal input terminal thereof, and the first clock signal has a logic low level in one period and a logic high level in another period, the second clock signal is a signal which is shifted from the first clock signal by ½ a duty period, and the third clock signal is a signal which is shifted from the second clock signal by ½ the duty period.

17. The scan driver of claim 16, wherein: the second clock signal is input into a first clock signal input terminal of a second scan driving block arranged after the first scan driving block, the third clock signal is input into a second clock signal input terminal thereof, and a fourth clock signal which is a signal shifted from the third clock signal by ½ the duty period is input into a third clock signal input terminal thereof.

18. The scan driver of claim 1, wherein:

a first clock signal is input into the first clock signal input terminal of any one first scan driving block among the plurality of scan driving blocks, a second clock signal is input into the second clock signal input terminal thereof, and a third clock signal is input into the third clock signal input terminal thereof, and the first clock signal has a logic low level in a first period and a logic high level in second, third, and fourth periods, the second clock signal is a signal which is shifted from the first clock signal by 1 duty period, and the third clock signal is a signal which is shifted from the second clock signal by 1 duty period.

19. The scan driver of claim 18, wherein: the second clock signal is input into a first clock signal input terminal of a second scan driving block arranged after the first scan driving block, the third clock signal is input into a second clock signal input terminal thereof, and a fourth clock signal which is a shifted from the third clock signal by the 1 duty period is input into a third clock signal input terminal thereof.

20. The scan driver of claim 17, wherein: the third clock signal is input into a first clock signal input terminal of a third scan driving block arranged after the second scan driving block, the fourth clock signal is input into a second clock signal input terminal thereof, and the first clock signal is input into a third clock signal input terminal thereof.

21. The scan driver of claim 20, wherein: the fourth clock signal is input into a first clock signal input terminal of a fourth scan driving block arranged after the third scan driving block, the first clock signal is input into a second clock signal input terminal thereof, and the second clock signal is input into a third clock signal input terminal thereof.

22. The scan driver of claim 1, wherein: respective scan signals of a previously driven one of the plurality of scan driving blocks are input into the driving signal input terminals of subsequently driven ones the plurality of scan driving blocks.

23. A driving method of a scan driver including a plurality of scan driving blocks including a first node, a second node, a first transistor including a gate electrode connected to the second node and configured to transfer an output control signal to an output terminal, a second transistor including a gate electrode connected to the first node and configured to transfer a first clock signal to the output terminal, a third transistor including a gate electrode to which the first clock signal is applied and a first electrode connected to the first node and configured to transfer a voltage of the output terminal to the first node, and a capacitor connected to the first node and the output terminal, the method comprising:

varying a voltage of the second node by an output control signal at a gate-on voltage; and turning on the first transistor by varying the voltage of the second node and outputting the output control signal of the gate-on voltage to the output terminal as a scan signal, wherein the output control signal varies between at least two voltage levels.

24. The driving method of a scan driver of claim 23, wherein: varying the voltage of the second node and outputting the output control signal of the gate-on voltage as the scan signal are performed concurrently in the plurality of scan driving blocks.

25. The driving method of a scan driver of claim 23, further comprising:

transferring a gate-off voltage to the first node in accordance with the output control signal of the gate-on voltage.

26. The driving method of a scan driver of claim 23, further comprising:

applying a scan signal of gate-on voltage output from a scan driving block previously driven among the plurality of scan driving blocks in accordance with a second clock signal, to the first node;

turning on the second transistor by the gate-on voltage of the first node and outputting a first clock signal of gate-off voltage to the output terminal as the scan signal; and charging the capacitor in accordance with the gate-on voltage at the first node and the gate-off voltage at the output terminal.

27. The driving method of a scan driver of claim 26, further comprising:

transferring a third clock signal of the gate-off voltage to the second node in accordance with the second clock signal and the scan signal at the gate-on voltage output by the previously driven scan driving block.

28. The driving method of a scan driver of claim 26, further comprising:

varying the first clock signal as the gate-on voltage;

turning on the second transistor by a bootstrap through the capacitor; and outputting the first clock signal at the gate-on voltage to the output terminal as the scan signal.

29. The driving method of a scan driver of claim 28, further comprising:

varying the first clock signal as the gate-off voltage; and maintaining a turn-on state of the second transistor with the voltage charged in the capacitor and outputting the first clock signal at the gate-off voltage to the output terminal.

30. The driving method of a scan driver of claim 29, further comprising:

transferring the gate-on voltage to the second node in accordance with a third clock signal at the gate-on voltage;

turning on the first transistor and the fourth transistor with the gate-on voltage of the second node and outputting the output control signal at the gate-off voltage to the output terminal as the scan signal;

turning on the third transistor in accordance with the first clock signal at the gate-on voltage; and transferring the output control signal at the gate-off voltage to the first node and turning off the second transistor.

* * * * *